US012515121B2

(12) United States Patent
Sterling

(10) Patent No.: US 12,515,121 B2
(45) Date of Patent: Jan. 6, 2026

(54) ARCADE GAME

(71) Applicant: Monte Sterling, Bozeman, MT (US)

(72) Inventor: Monte Sterling, Bozeman, MT (US)

( * ) Notice: Subject to any disclaimer, the term of this patent is extended or adjusted under 35 U.S.C. 154(b) by 499 days.

(21) Appl. No.: 18/100,374

(22) Filed: Jan. 23, 2023

(65) Prior Publication Data

US 2024/0245981 A1 Jul. 25, 2024

(51) Int. Cl.
*A63F 7/02* (2006.01)
*A63F 7/38* (2006.01)

(52) U.S. Cl.
CPC ..... *A63F 7/02* (2013.01); *A63F 7/38* (2013.01); *A63F 2250/142* (2013.01)

(58) Field of Classification Search
CPC ..... A63F 7/02; A63F 7/38; A63F 7/28; A63F 2007/3015; A63F 2007/303; A63F 2007/3666; G07F 17/3262; G07F 17/3265
See application file for complete search history.

(56) References Cited

U.S. PATENT DOCUMENTS 2,001,366 A * 5/1935 Mittelman ..... A63F 7/02 273/144 R
2,192,622 A * 3/1940 Radtke ..... A63F 7/025 273/121 A
2,223,981 A * 12/1940 Armstrong, Jr. ..... A63F 7/06 273/118 D
3,333,851 A * 8/1967 Rosen ..... A63F 7/04 273/120 R
3,403,459 A * 10/1968 Divilbiss ..... A63F 7/02 434/189
3,787,055 A 1/1974 Kreamer
3,815,917 A 6/1974 Brown
3,934,881 A * 1/1976 Goldfarb ..... A63F 7/02 273/120 R (Continued)

FOREIGN PATENT DOCUMENTS

CZ 13374 U1 6/2003
DE 102005004301 A1 * 7/2006 ..... A63F 7/02

(Continued)

OTHER PUBLICATIONS

Slam-a winner Ticket Redemption Ball Drop Arcade Game (https://www.youtube.com/watch?v=tiAtHky8foA); Date Accessed: Jun. 21, 2022.

*Primary Examiner* — Christine M Mills
(74) *Attorney, Agent, or Firm* — Antoinette M. Tease

(57) ABSTRACT

An arcade game having a housing that forms an interior compartment containing three lower and three upper platforms and a perforated platform. The three lower platforms are underneath the perforated platform, tilted toward downwardly, and parallel to each other. The perforated platform is horizontal with a plurality of apertures configured to allow a ball to pass through them. Two levers at the front of the housing are pivotally connected to a bracket and mechanically coupled to one of the upper platforms via a cable and pulley. A central connecting rod extends through the center of the three upper platforms with a ball bearing at each point at which the rod passes through the platform. Two rear connecting rods connect the rear corners of the three upper platforms to each other with a ball bearing at each point at which the rear connecting rods extend through the platforms.

8 Claims, 29 Drawing Sheets

(56) References Cited

U.S. PATENT DOCUMENTS

| | | | | | |
|---|---|---|---|---|---|
| 4,089,526 | A | | 5/1978 | Olving | |
| 4,240,628 | A | * | 12/1980 | Brownfield | A63F 7/02 273/110 |
| 4,332,385 | A | | 6/1982 | McCaslin | |
| 5,634,639 | A | | 6/1997 | Tokito et al. | |
| 5,732,945 | A | | 3/1998 | Sofia | |
| 9,707,460 | B1 | * | 7/2017 | Sterling | A63B 63/08 |

FOREIGN PATENT DOCUMENTS

| | | | | |
|---|---|---|---|---|
| FR | 1025556 | A | * | 4/1953 |
| FR | 2406463 | A | * | 6/1979 |

* cited by examiner

ARCADE GAME

BACKGROUND OF THE INVENTION

1. Field of the Invention

The present invention relates generally to the field of games, and more particularly, to an arcade game in which balls are directed through a series of adjustable platform mazes by the user in combination with the forces of gravity.

2. Description of the Related Art

U.S. Pat. No. 5,634,639 (Tokito et al., 1997) discloses a ball game apparatus that has a plurality of balls, a spiral rail for automatically delivering the balls, a field portion on which the balls delivered by the spiral rail can roll with a certain degree of freedom, winning pocket portions and invalid pockets formed over the field portion. The invention includes a sensor means for counting the number of balls received by the winning pocket portions. The inventor touts the fact that the invention does not require any skill or knowledge on the part of the operator; this invention appears to be strictly a game of chance.

U.S. Pat. No. 4,089,526 (Olving, 1978) describes a game that is played on an upper tray and scored on a lower tray. The upper tray is supported on gimbals and manipulated by the user via a single handle that tilts the tray to induce a ball to move by gravity alone a particular path. Holes are provided in the upper tray through which the ball can fall into the lower tray. The lower tray is inclined so that the ball will fall down into a score-determining position. Both trays are plana surfaces free of any obstructions.

U.S. Pat. No. 3,934,881 (Goldfarb et al., 1976) provides a manipulative skill game in the form of a generally upright game board on which are horizontally extending platforms are tiltably mounted. The game includes a plurality of balls, and the platforms are arranged in staggered positions from side to side so that a ball rolling off one end of a platform will land on an end of a platform beneath it. The platforms are manipulated by the player via rotatable knobs.

U.S. Pat. No. 5,732,945 (Sofia, 1998) involves a toy maze made up of a container with a ball that passes through a plurality of passageways formed by vertically extending wall segments within the container. Each level is separated by a tray with a plurality of apertures, some of which are trap holes that are configured to limit the movement of the ball to only one direction. The container is manipulable about its three axes by the user. In one embodiment, the container is translucent.

U.S. Pat. No. 4,240,628 (Brownfield, 1980) discloses a skill game with multi-levels of plates, each of which is pivotably mounted on a support axis and contained within an enclosure assembly. Each plate has an opening that is large enough for a ball to pass through, and two manipulating rods are attached to each plate. Each rod has an arm member that extends outside of the enclosure assembly. Because each rod is attached to all of the plates, when one plate is tilted in a certain direction by movement of the rod, all of the plates that are attached to that same rod move in the same direction.

U.S. Pat. No. 3,787,055 (Kraemer, 1974) provides a tilt boar game having a frame, a tiltable playing board that is pivotable about a single point centrally located on one side of the frame, and a spring supported on the side opposite that of the pivot point. A plurality of barriers are disposed on the playing surface for guiding the ball. The game board is manipulated by the user via a handle that extends outwardly from the front edge of the game board.

U.S. Pat. No. 4,332,385 (McCaslin, 1982) discloses an apparatus for playing a game with a moveable player piece such as a ball. The invention includes a game board with start and finish positions and a maze that is mounted on the game board. The game board itself is manually manipulated by tilting it up and down and side to side. The maze is coupled by a shaft to a mechanical or electric drive motor that is mounted below the game board surface, and the speed of the motor can be changed to vary the speed of rotation of the maze.

U.S. Pat. No. 3,815,917 (Brown, 1974) involves a table that is used as a playing field for a rollable ball. The table is tiltable about one or both of a pair of substantially horizontal perpendicular axes by means of a power source for tilting the table. The powering means is deployed at a remotely positioned operator's station. According to the inventor, the invention requires little physical exertion as all the user has to do is manipulate the table via the remote control device.

BRIEF SUMMARY OF THE INVENTION

The present invention is an arcade game comprising: a housing that forms an interior compartment; three lower platforms; a perforated platform; and three upper platforms; wherein the three lower platforms are situated underneath the perforated platform, tilted toward the back of the housing, and parallel to each other; wherein the perforated platform is substantially horizontal and comprised of a plurality of apertures configured to allow a ball to pass through them; wherein the three upper platforms are situated above the perforated platform; wherein each of two levers situated at a front of the housing is pivotally connected to a lever mounting bracket and mechanically coupled to one of the three upper platforms via a cable and pulley; wherein a lever spring is attached to each of the two levers and configured to maintain the lever in an upright position when the lever is in a resting position; wherein a central connecting rod extends through a center of the three upper platforms, and a ball bearing is situated at each point at which the central connecting rod extends through one of the three upper platforms; wherein a first rear connecting rod is connected to a first rear corner of each of the three upper platforms, and a ball bearing is situated at each point at which the first rear connecting rod connects to one of the three upper platforms; and wherein a second rear connecting rod is connected to a second rear corner of each of the three upper platforms, and a ball bearing is situated at each point at which the second rear connecting rod connects to one of the three upper platforms.

In a preferred embodiment, the invention further comprises a frame; wherein each of the three upper platforms comprises a pair of platform springs that are connected on one end to a rear corner of the upper platform and on another end to the frame; and wherein the platform springs are configured to maintain the upper platforms in a substantially horizontal position when the levers are in a resting position. Preferably, the invention further comprises a ramp; wherein the three lower platforms comprise a first lower platform that is situated directly underneath the perforated platform, a second lower platform that is situated directly underneath the first lower platform, and a third lower platform that is situated directly underneath the second lower platform; wherein the ramp is situated directly underneath the third lower platform; wherein each of the first lower platform, the second lower platform, and the third lower platform is configured to deliver the ball to a ball trough; wherein the ball trough is configured to transfer the ball to a ball blower via a ball feeder assembly; and wherein the ball blower is configured to send the ball through a vertical chute and deposit it onto a highest of the three upper platforms. The perforated platform preferably comprises a plurality of tubes that extend downwardly from the perforated platform; wherein each tube is configured to receive the ball as it passes through one of the plurality of apertures in the perforated platform; wherein at least one of the downwardly extending tubes terminates above the first lower platform, at least one of the downwardly extending tubes terminates above the second lower platform, and at least one of the downwardly extending tubes terminates above the third lower platform; and wherein the ramp comprises an aperture that is configured to deliver the ball to the ball trough.

In a preferred embodiment, each of the upper platforms and each of the lower platforms comprises one or more ball-directing walls. Preferably, each of the three upper platforms comprises one or more apertures that are configured to allow the ball to pass through them; and each of the three upper platforms comprises at least one tube extending downwardly from an aperture in the upper platform. The three upper platforms preferably comprise a third upper platform that is situated directly above the perforated platform, a second upper platform that is situated directly above the second upper platform, and a first upper platform that is situated directly above the second upper platform; wherein the third upper platform comprises more than one downwardly extending tube, and wherein the downwardly extending tubes of the third upper platform vary in length.

In a preferred embodiment, the invention further comprises: a plurality of prize augers that are situated above the three upper platforms and configured to deliver a prize to a prize chute and into a prize box; and sensors that are configured to detect whether the ball is delivered to the ball trough from the first lower platform, the second lower platform, the third lower platform, or the ramp and to trigger delivery of a corresponding prize or no prize at all.

REFERENCE NUMBERS

Figure 1:
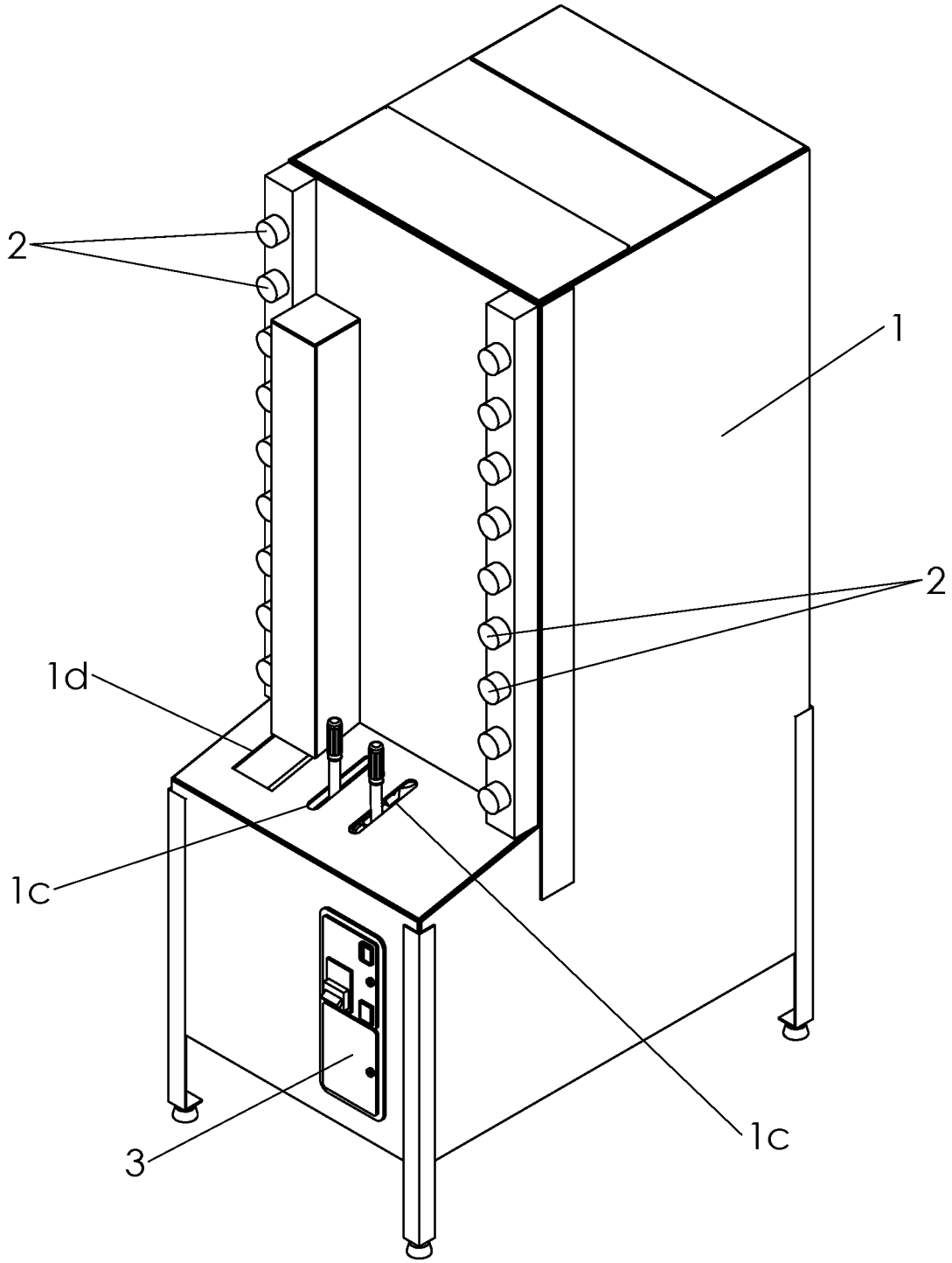
FIG. 1 is a front perspective view of the present invention.

1 Housing
1*a* Interior compartment (main)
1*b* Interior compartment (front extension)
1*c* Slot
1*d* Aperture
2 Lights
3 Money collection box
4 Lever
4*a* Lever mounting bracket
5 Upper platform
5*a* First upper platform
5*b* Second upper platform
5*c* Third upper platform
6 Perforated platform
7 Lower platform
7*a* First lower platform
7*b* Second lower platform.
7*c* Third lower platform
8 Frame
8*a* Upright post
8*b* Front leg
9 Floor
10 Ceiling
10*a* First coiling panel
10*b* Second ceiling panel
11 Sheath
11*a* Foot
12*a* Upper rear panel door
12*b* Lower rear panel door

13 Platform spring
14 Lever spring
15 Spring mounting bracket
16 Cable
17 Pulley
18 Bracket
19 Connecting rod
20 Ball bearing.
21 Central post
22 Stabilizing bracket
23 Prize auger
24 First prize chute
25 Second prize chute
26 Prize box
27 Ball blower
28 Vertical ball chute
29 Funnel
30 Ball-directing wall
31 Hole (in upper platform)
32 Tube
33 Volt converter
34 Power strip
35 Transformer
36 Ball feeder assembly
37 Tube
38 Prize off switch
39 Digital readout processor
40 Digital I/O board
41 Rear plate
42 Ball sensor
42*a* First ball sensor
42*b* Second ball sensor
43 Black strip
44 Ramp
45 Ball trough
46 Sensor
46*a* First sensor
46*b* Second sensor
46*c* Third sensor
46*d* Fourth sensor
47 Receptacle
48 Dowel
49 Cradle
50 Eyelet

DETAILED DESCRIPTION OF INVENTION

FIG. 1 is a front perspective view of the present invention. As shown in this figure, the invention comprises a generally upright housing 1, which defines an interior compartment (see FIG. 2). The interior compartment includes a main compartment 1*a* that extends from the bottom of the invention to the top of the invention and is generally upright in orientation and a front extension 1*b*, which extends forwardly from the main compartment 1*a* at the bottom of the invention. In a preferred embodiment, the housing 1 is made of a solid, durable and transparent material such as clear acrylic. The upper and lower platforms 5, 7 (see FIG. 2) are preferably transparent as well.

In a preferred embodiment, two columns of lights 2 are situated on the front of the housing 1. Although lights are preferably incorporated into the present invention, the invention is not limited to any particular number or configuration of lights. Similarly, speakers (not shown) for audio entertainment are preferably incorporated into the invention as well, but the invention is not dependent upon the incorporation of speakers. A money collection box 3 is disposed on the bottom of the front part of the housing 1 and configured to activate the game upon deposit of a preset monetary amount of coins and/or bills.

Figure 2:
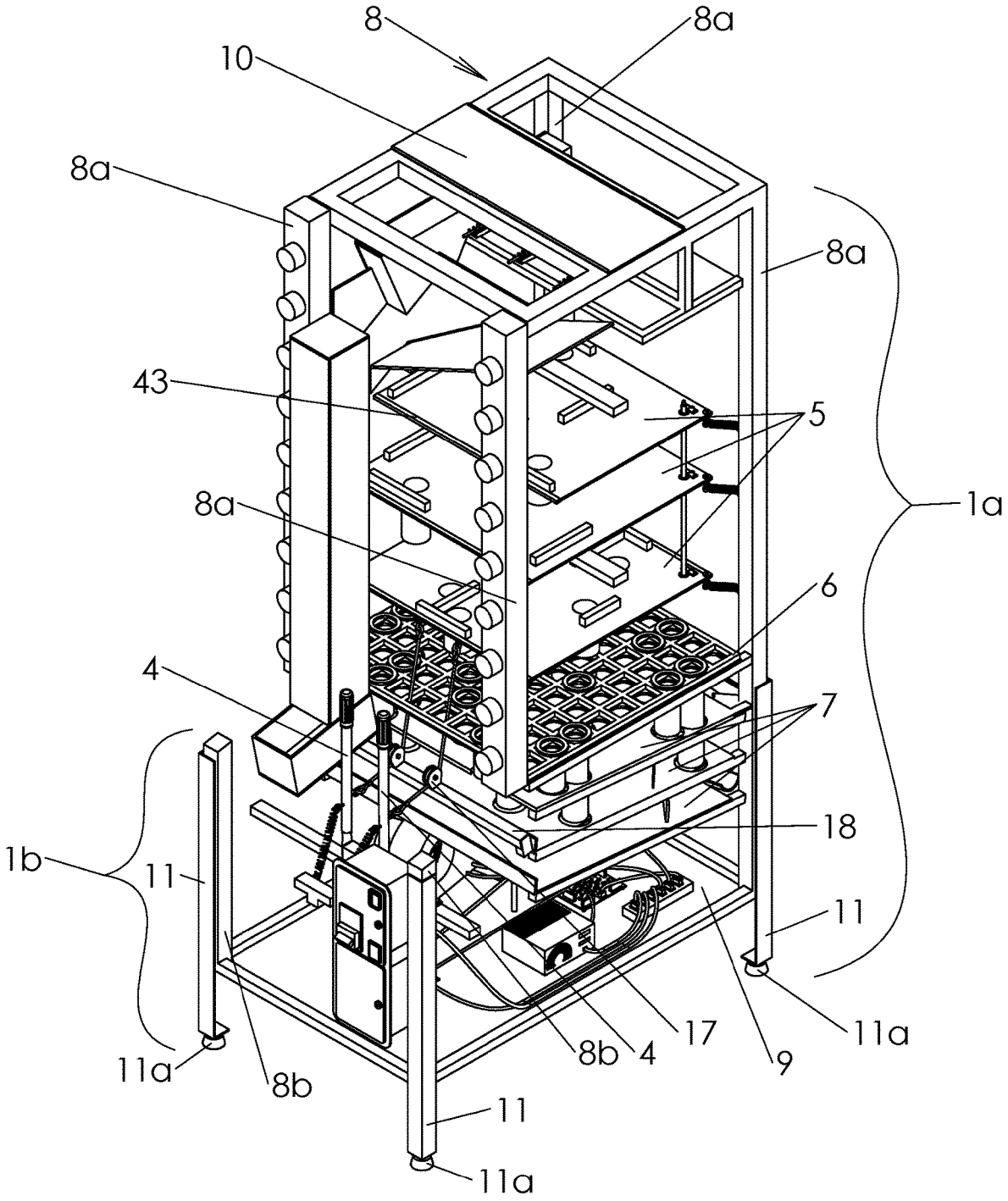
FIG. 2 is a front perspective view of the present invention shown with the housing removed.

FIG. 2 is a front perspective view of the present invention shown with the housing removed. As shown in this figure, the invention comprises a frame 8, which is comprised in part of four upright posts 8*a*. The two rear-most upright posts 8*a* extend from the floor 9 of the invention to the ceiling 10 of the invention. (Note that the floor 9 defines the bottom of the main compartment 1*a*, as well as the bottom of the front extension 1*b* of the interior compartment, whereas the ceiling 10 exists only over the main compartment 1*a*.) The two front-most upright posts 8*a* extend from the top of the front extension 1*b* to the ceiling 10. The frame also comprises two front legs 8*b*, which extend from the floor 9 to the top of the front extension 1*b* and define the front of the front extension 1*b*. The front of each of the upper platforms 5 preferably comprises a black strip 43 of rigid material (for example, metal or plastic) that prevents the platform from warping and acts as a visual marker against the transparent platform.

In a preferred embodiment, that part of the housing 1 that overlies the front extension 1*b* is slanted downwardly from back to front, as shown in FIG. 1, so that the top end of each front leg 8*b* is on a lower horizontal plane than the bottom end of the two front-most upright posts 8*a*. This part of the housing 1 also comprises an aperture 1*d* for collection of a prize (see FIG. 1). The invention further comprises a sheath 11 on each of the two rear-most upright posts 8*a* and the two front legs 8*b*. Each sheath 11 comprises a foot 11*a* and is configured to stabilize and support the weight of the invention on a surface.

Figure 28:
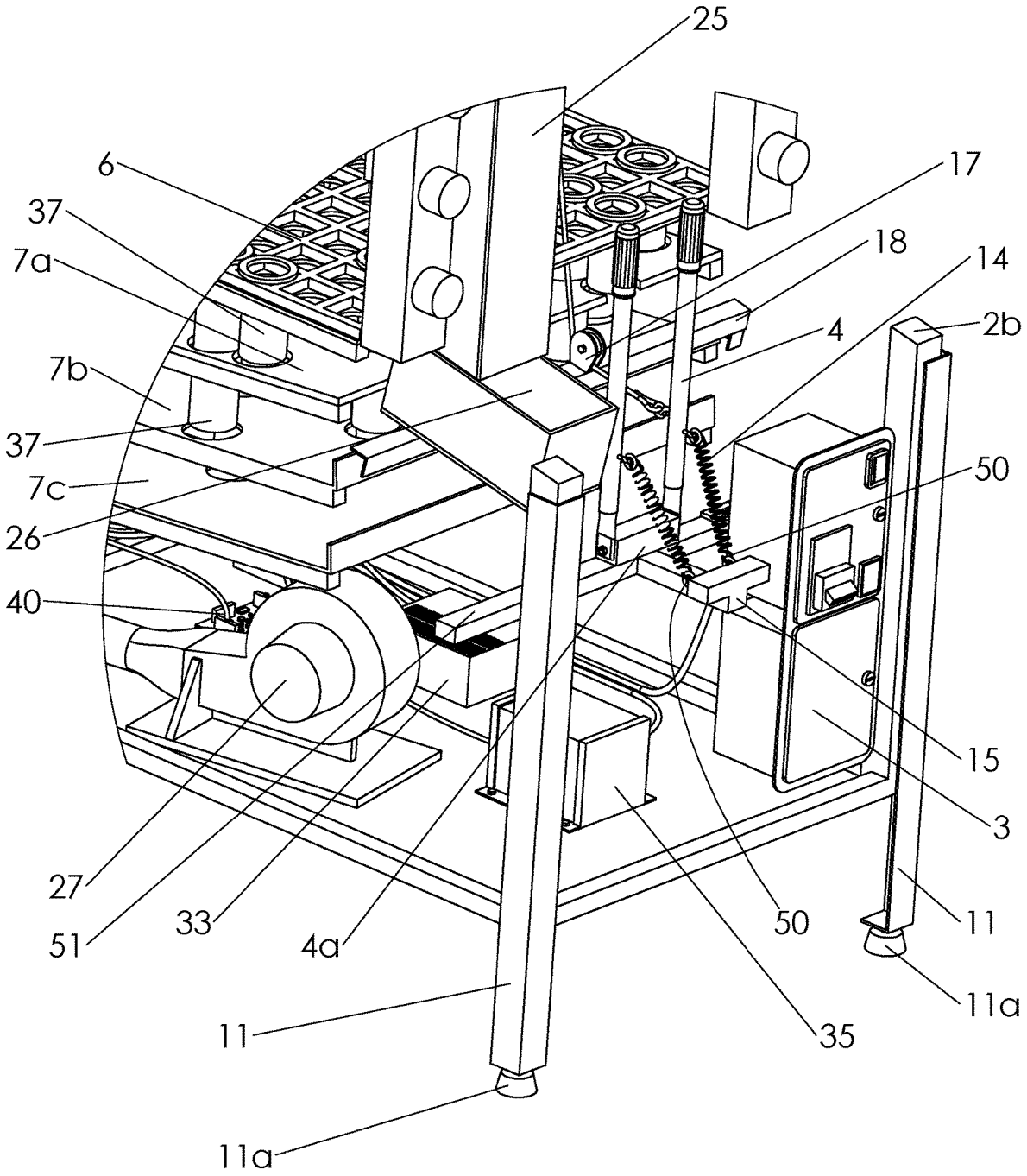
FIG. 28 is a detail perspective view of the front end of the lower platforms, levers and lever springs.

As shown in FIG. 2, two levers 4 are provided for operation of the game by a player. The bottom end of each lever 4 is pivotally attached to a lever mounting bracket 4*a* (see also FIG. 28). As shown in FIG. 1, the levers 4 extend upwardly through slots 1*c* in the top of that part of the housing 1 that defines the front extension 1*b* of the interior compartment.

The main interior compartment 1*a* contains three upper platforms 5, a perforated platform 6, and three lower platforms 7. The upper platforms 5 are situated above the perforated platform 6, and the lower platforms 7 are situated beneath the perforated platform 6. Each of the three upper platforms 5 is moveable, as described more fully below. The perforated platform 6 is preferably square in shape and fixedly attached to the four corners of the frame (that is, the four upright posts 8*a*) in a horizontal orientation. Specifically, the perforated platform 6 is attached to the two rear-most upright posts 8*a* at a point between the floor 9 and the ceiling 10 and to the bottom ends of the two front-most upright posts 8*a*. The lower platforms 7 are fixedly attached to the two rear-most upright posts 8*a* and also to the housing 1 (not shown) so as to maintain the position shown in the figures. Each lower platform is angled downwardly (preferably at an angle of seven degrees or greater) from front to back (see also FIG. 6), and the three lower platforms 7 are preferably parallel to each other.

Figure 3:
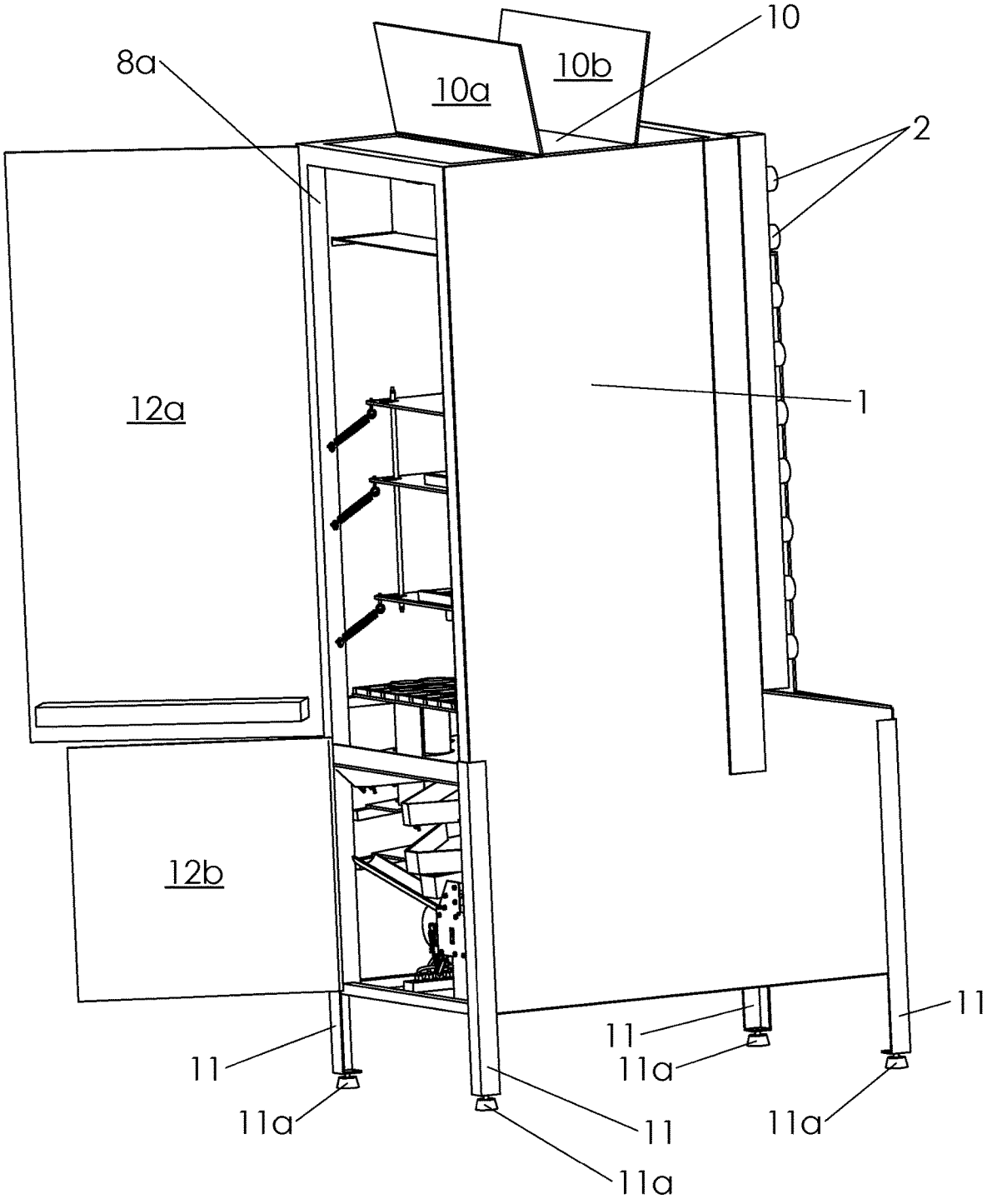
FIG. 3 is a rear perspective view of the present invention shown with the housing installed and the back doors in an open position.

FIG. 3 is a rear perspective view of the present invention shown with the housing installed and the back doors in an open position. This figure clearly shows the four sheaths 11 and feet 11*a*. It also shows the upper rear panel door 12*a* and the lower rear panel door 12*b*, both of which are pivotally attached to one of the two rear-most upright posts 8*a* and configure to allow access to the interior compartment via the back of the invention. Note that the two ceiling panels 10*a*,

10*b* are also preferably pivotable for easy access to the prize augers 23 for reloading prizes.

Figure 4:
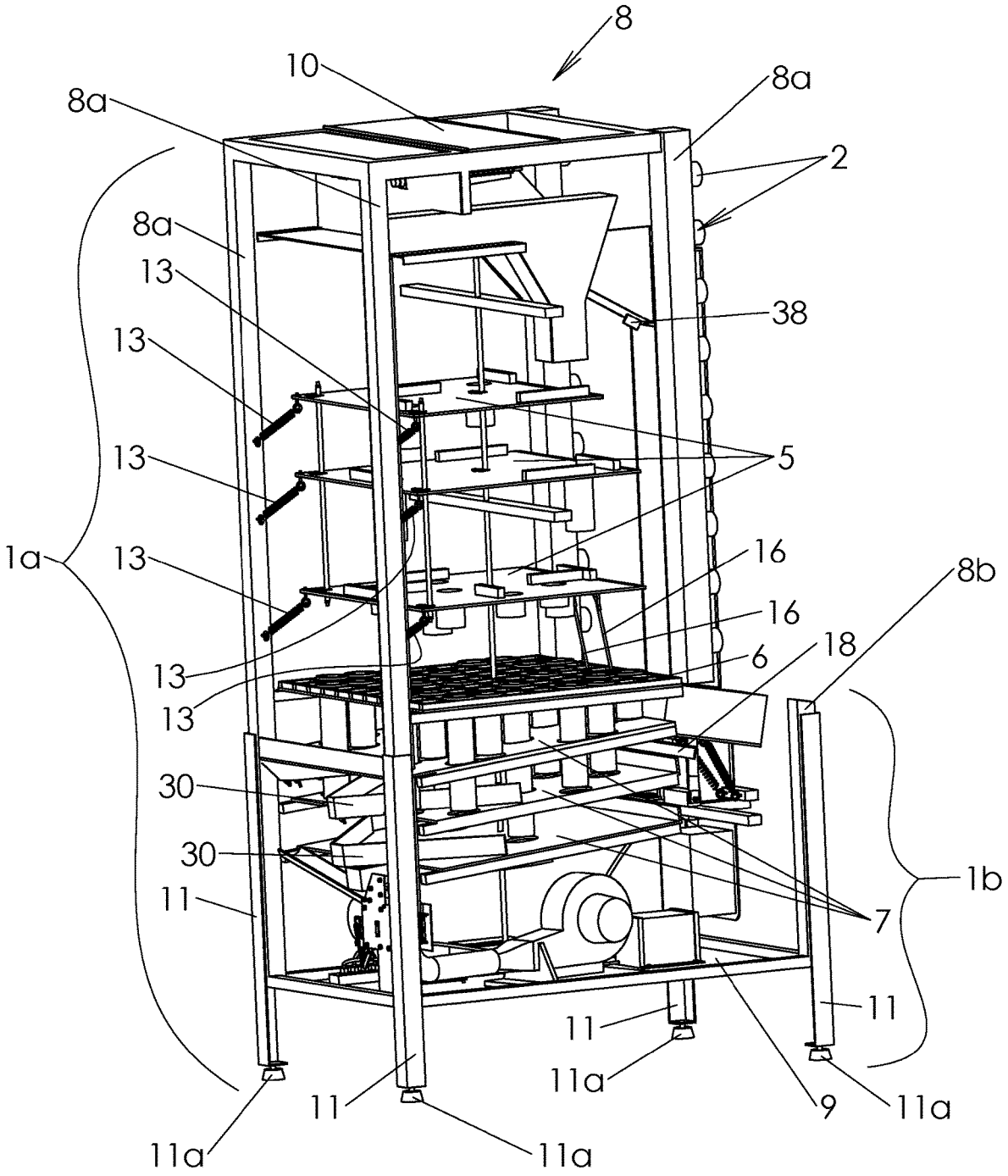
FIG. 4 is a rear perspective view of the present invention shown with the housing removed.

FIG. 4 is a rear perspective view of the present invention shown with the housing removed. In this figure, the three upper platforms 5 are in a resting, or horizontal, position. Each of the upper platforms is either square or rectangular in shape with two rear corners. Each of the rear corners of each upper platform is attached to a platform spring 13. One end of the platform spring 13 is attached to the upper platform 5, and the other end of the platform spring 13 is attached to one of the two rear-most upright posts 8*a* (the one that is closest to the corner of the upper platform to which the spring is attached) at a point that is lower than the rear corner of the upper platform 5 in a resting position. The "resting position" of the upper platforms 5 is the position of the upper platforms when no force is applied to the platform spring 13.

Figure 5:
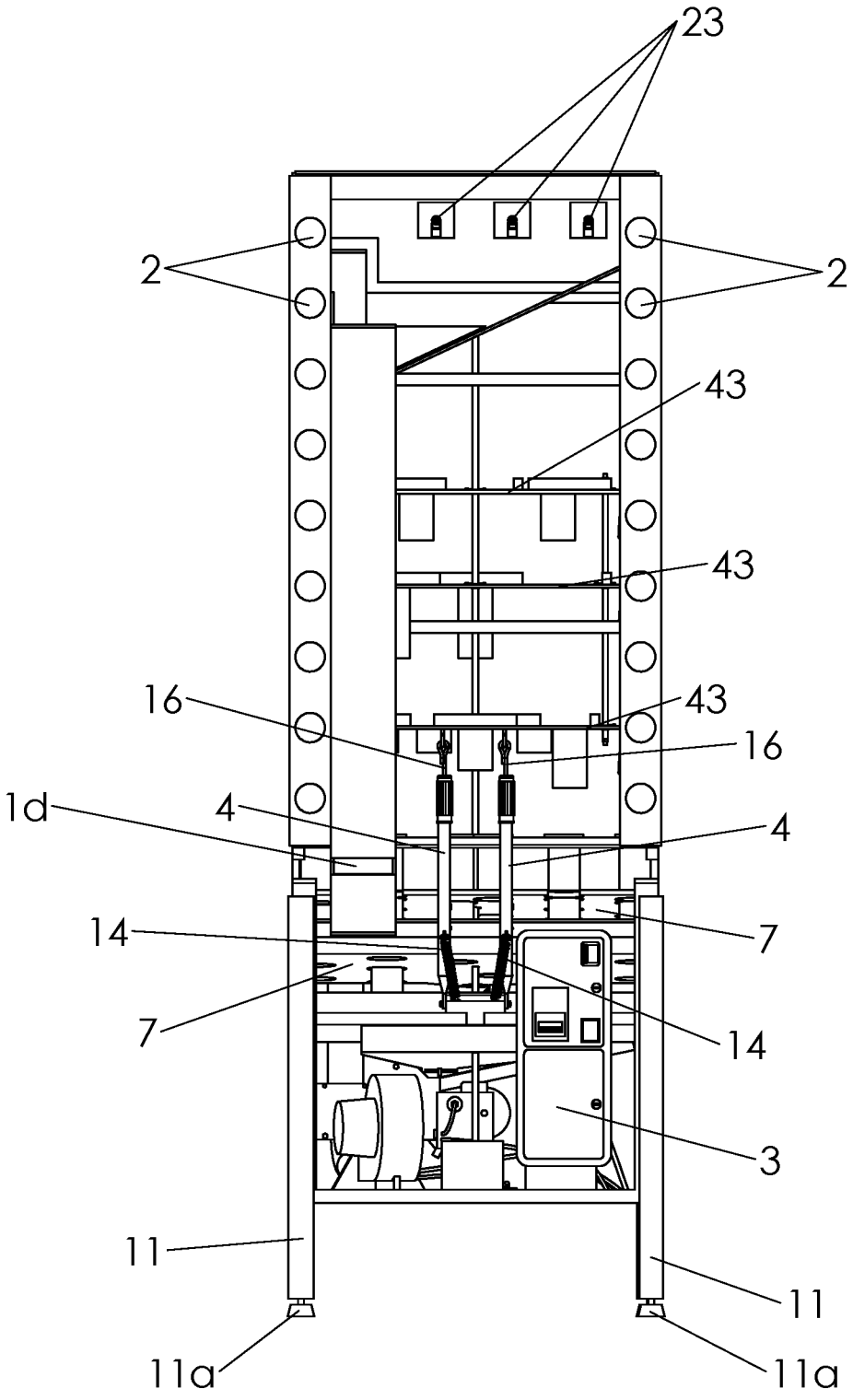
FIG. 5 is a front view of the present invention shown with the housing removed.

FIG. 5 is a front view of the present invention shown with the housing removed. As shown in this figure and in FIG. 28, a pair of lever springs 14 is attached via eyelets 50 to a spring mounting bracket 15 that is situated forwardly of the lever mounting bracket 4*a* within the front extension 1*b* of the interior compartment. Although the housing 1 is not shown in this figure, both the spring mounting bracket 15 and the lever mounting bracket 4*a* are attached to one or more brackets that are secured to the housing, thereby maintaining the two brackets 15, 4*a* in a stationary position (see also FIG. 28). Each lever spring 14 is attached on one end to the spring mounting bracket 15 and on the other end to the lever 4. A cable 16 is attached to the approximate center of the lever 4 and passes through a pulley 17 that is positioned on a horizontally mounted bracket 18 that is situated at approximately the same level as the center of the levers 4. Although the housing 1 is not shown in this figure, this particular bracket 18 is fixedly attached to the housing 1 so that it remains stationary. Next, each cable 16 passes through perforations (or apertures) in the perforated platform 6 and is attached to the front edge of the lowest of the three upper platforms 5 (see also FIG. 6). In a preferred embodiment, the cable 16 is a bungee cord. The purpose of the lever springs 14, working in tandem with the platform springs 13, is to maintain the levers 4 in an upright position (as shown in FIG. 2) when the game is not in play (that is, when no force is placed on the levers by the player).

Figure 6:
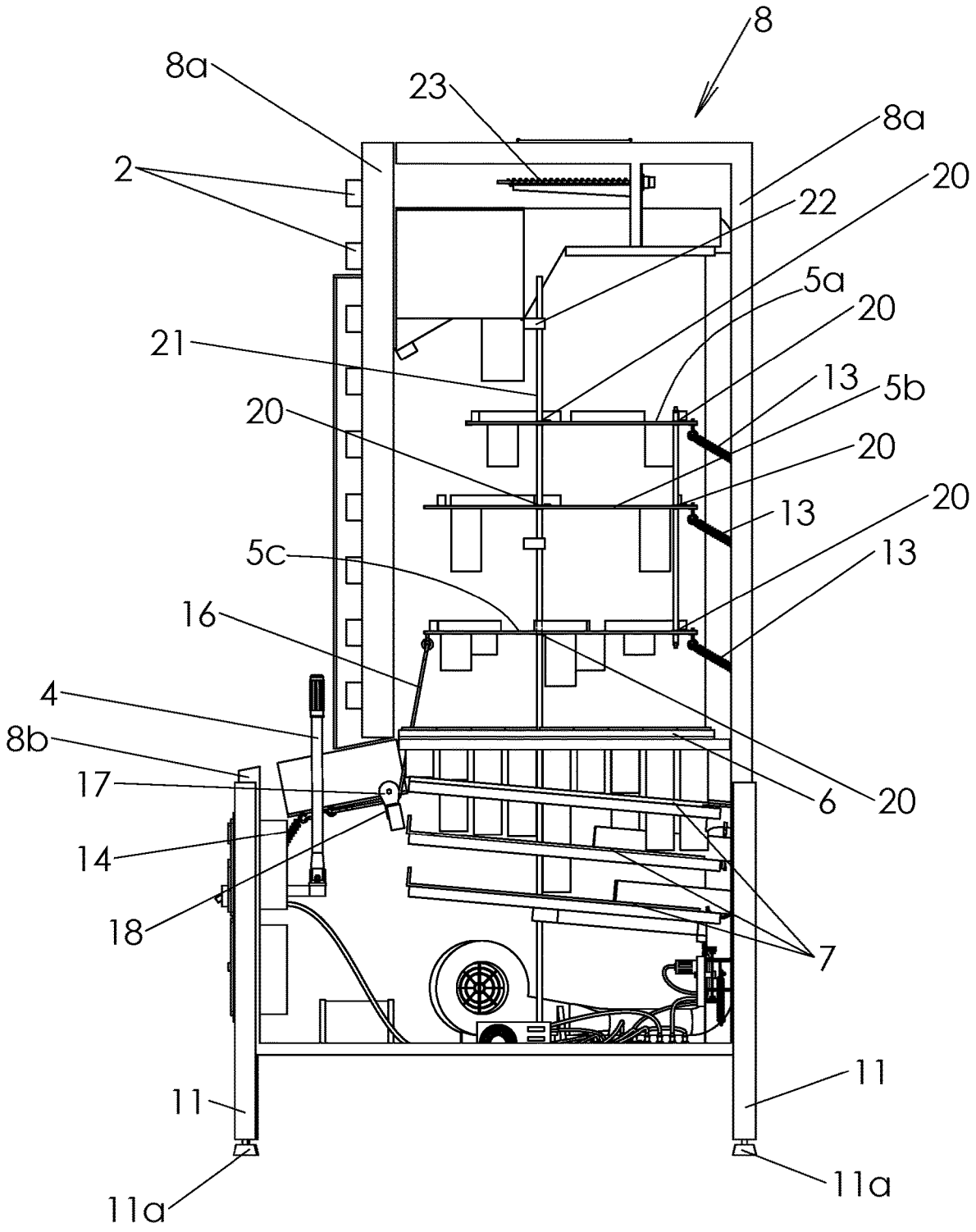
FIG. 6 is a first side view of the present invention shown with the housing removed.

FIG. 6 is a first side view of the present invention shown with the housing removed. As noted above, the three lower platforms 7 are parallel to each other and slanted downwardly from front to back. The perforated platform 6 is horizontal and situated above the three lower platforms 7. The perforated platform 6 is preferably at the same level as the rear edge of the top surface of the front extension 1*b* of the interior compartment. The three lower platforms 6 and the perforated platform 6 are approximately the same size (width and depth) as the main compartment 1*a*. The upper platforms 5 include a first upper platform 5*a*, a second upper platform 5*b*, and a third upper platform 5*c*. Each of the first, second and third upper platforms 5*a*, 5*b*, 5*c* is preferably smaller (width and/or depth) than the perforated platform 6. In a preferred embodiment, the upper platform 5*a* is smaller (width and/or depth) than the upper platforms 5*b*, 5*c* beneath it, and the upper platforms 5*b*, 5*c* are the same size. Each cable 16 is attached to the front end of the third upper platform 5*c*. As shown in FIG. 2, the perforated platform 6 is comprised of a plurality of open circles and/or squares, each of which is configured to allow a ball to pass through it.

As shown in FIG. 6 (see also FIG. 9), a pair of connecting rods 19 is fixedly attached to the rear edge of each of the three upper platforms 5. In this manner, the connecting rods 19 maintain a fixed distance between the upper platforms 5 and cause them to move together when the lowest of the three platforms 5*c* is tilted via the levers 4 (see also FIG. 4). At each connection point between the connecting rod 19 and the platform 5*a*, 5*b*, 5*c*, there is a ball bearing 20, which allows the platform to tilt relative to the connecting rod 19. A central post 21 extends vertically from the perforated platform 6 through each of the upper platforms 5*a*, 5*b*, 5*c* at a point on the platform that is forward of the connecting rod 19 and more or less centrally located on the platform (although not necessarily in the exact center of each platform 5). There is a ball bearing 20 at each connection point between the central post 21 and the platform 5*a*, 5*b*, 5*c*, which allows the platform to tilt relative to the central post 21. (The present invention includes a total of nine ball bearings.) The central post 21 is secured to the perforated platform 6 on its bottom end and secured to a stabilizing bracket 22 at or around its upper end. Although the housing 1 is not shown in this figure, this particular bracket 22 is fixedly attached to the housing 1 so that it remains stationary.

Figure 7:
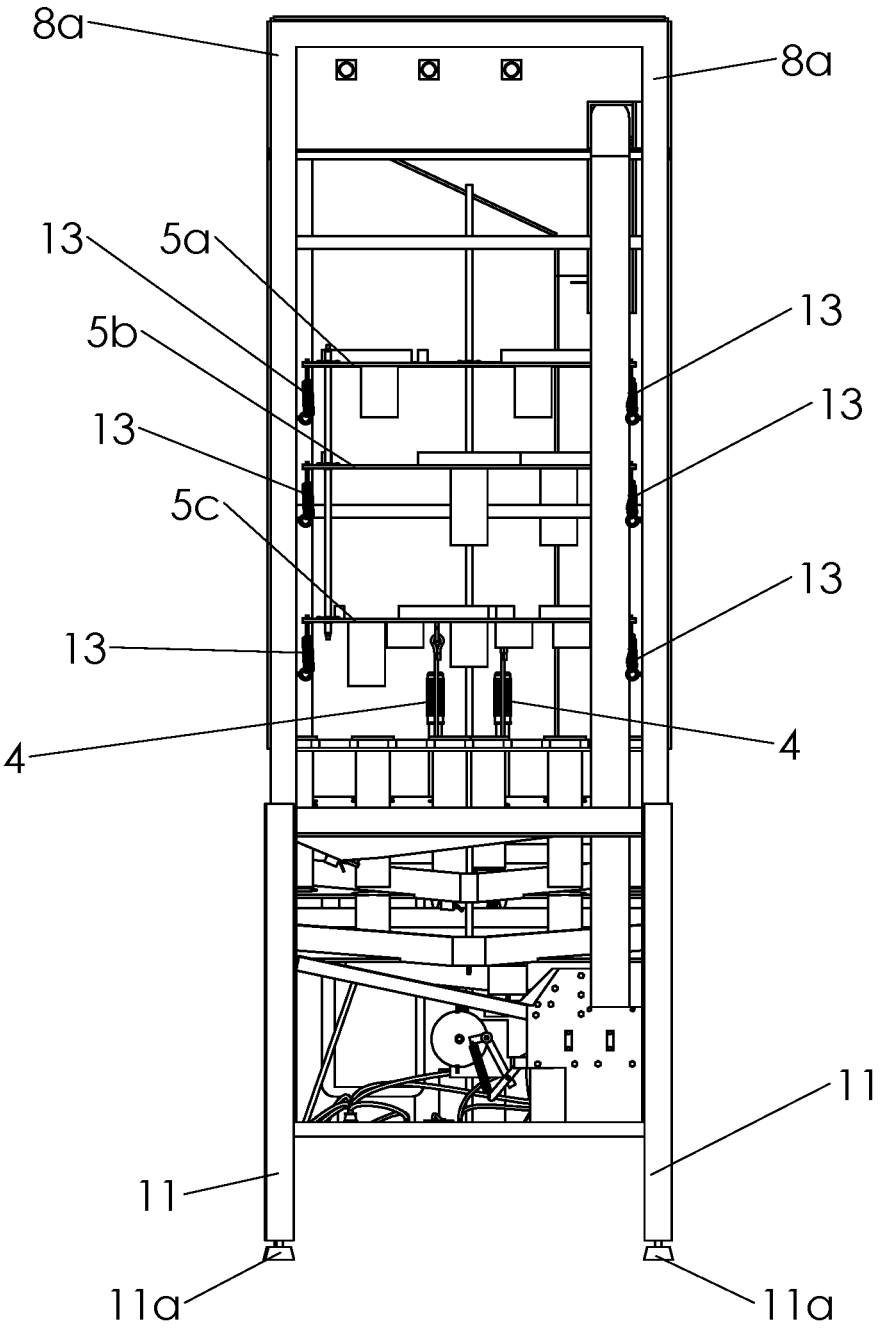
FIG. 7 is a rear view of the present invention shown with the housing removed.

FIG. 7 is a rear view of the present invention shown with the housing removed. As show in this figure, three prize augers 23 (each of which has its own small motor) are provided at the top of the interior compartment, directly underneath the ceiling 10. These prize augers 23 are configured to release a prize (not shown) onto a first prize chute 24, which delivers the prize into a second prize chute 25 and into a prize collection box 26 (see also FIG. 8). The first prize chute 24 is preferably in the form of a ramp that is at a relatively steep angle (at least forty-five degrees). The second prize chute 25 is preferably in the form of a vertical box; in a preferred embodiment, the second prize chute 25 is also transparent. The prize collection box 26 is accessible to the player via the aperture 1*d*, which is configured to allow the player to retrieve the prize from the prize collection box 26. FIG. 4 shows the prize off switch 38, which is configured to prevent more than one prize from being delivered to the first prize chute 24 until the game is reset.

Figure 8:
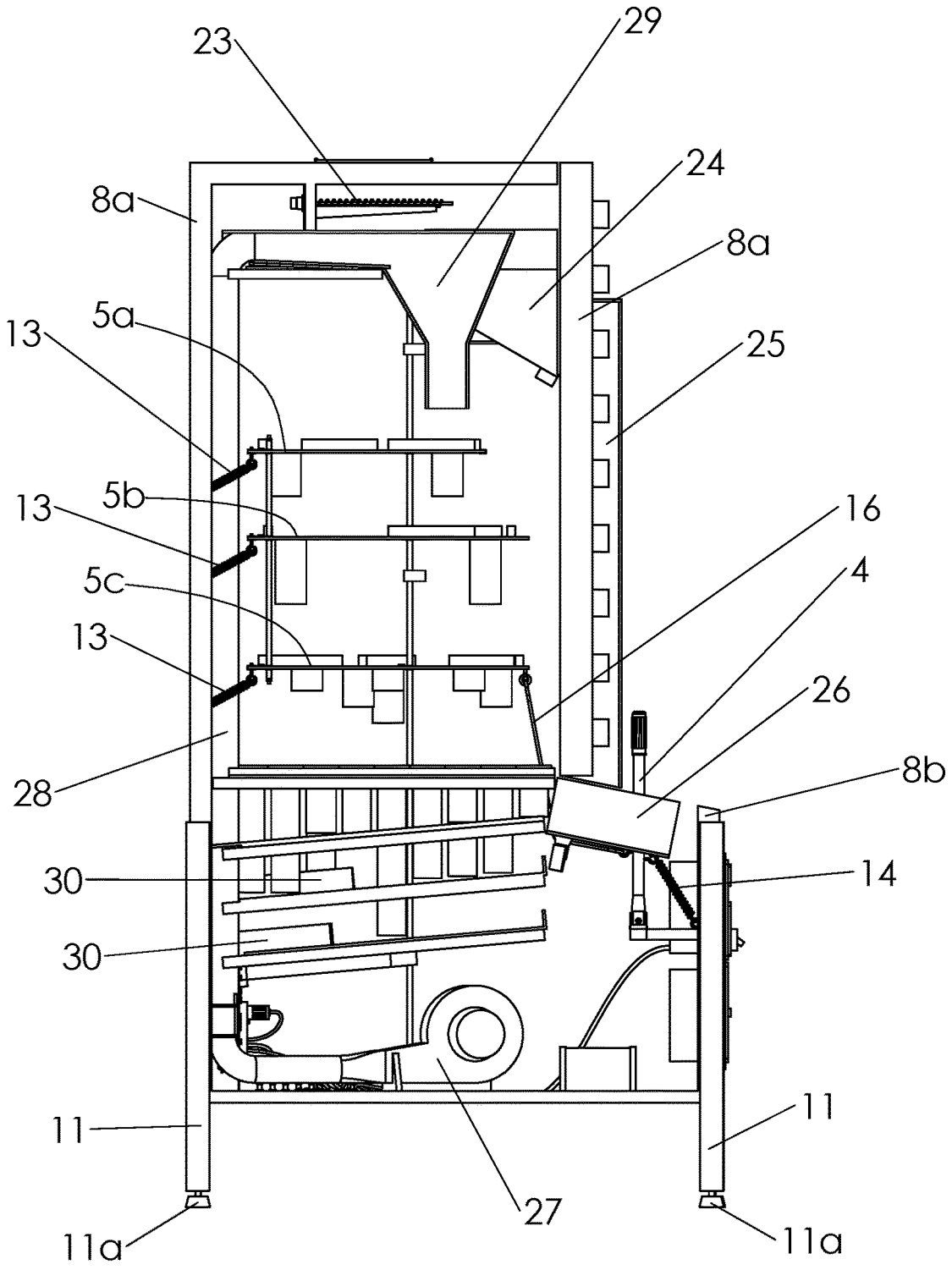
FIG. 8 is a second side view of the present invention shown with the housing removed.

FIG. 8 is a second side view of the present invention shown with the housing removed. As shown in this figure, the present invention comprises a ball blower 27, which blows balls, one at a time, up through a vertical ball chute 28 at the back of the game, and out through a downwardly pointed funnel 29, which deposits the ball (not shown) onto the first upper platform 5*a*.

Figure 9:
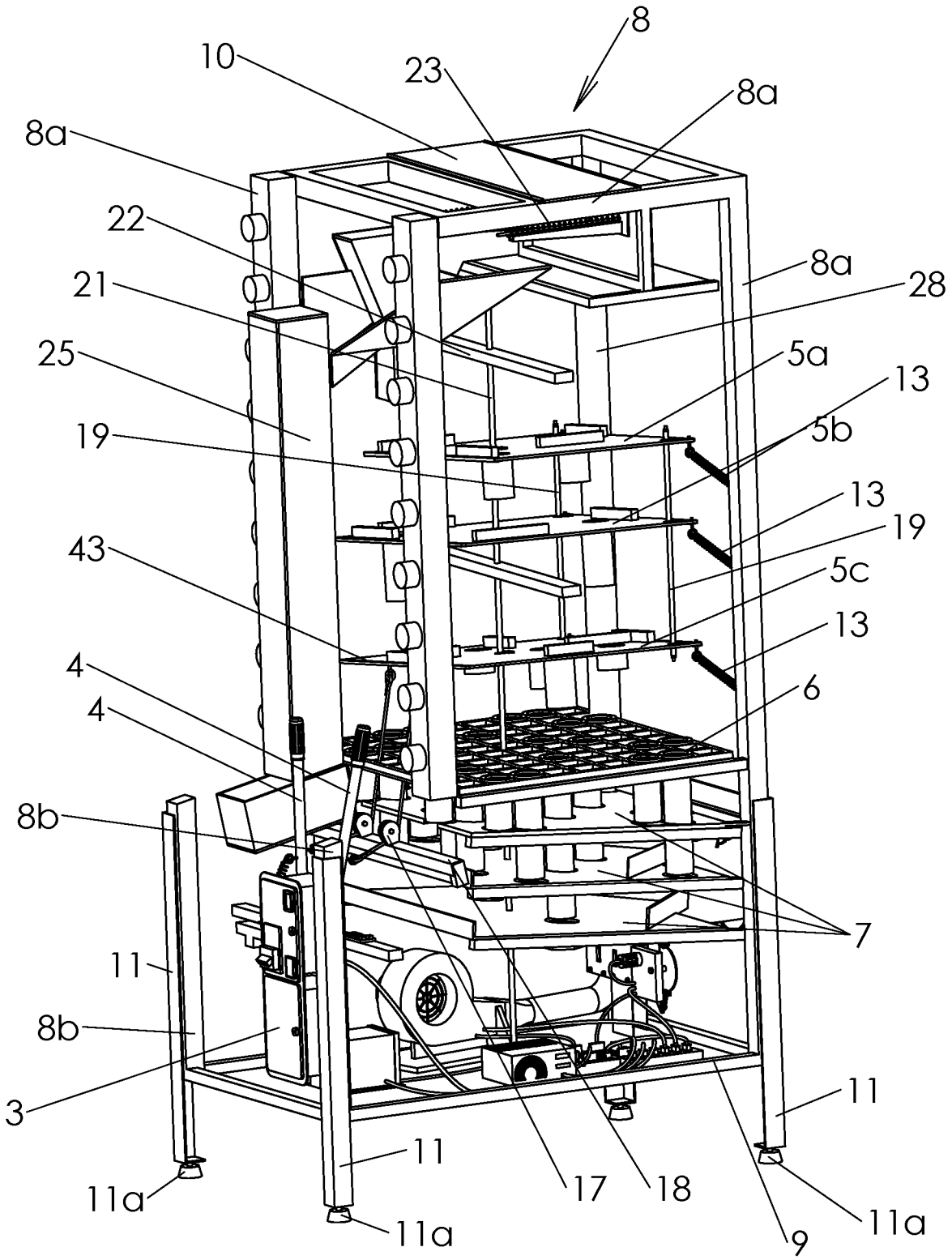
FIG. 9 is a side perspective view of the present invention shown with the right-hand lever in a rearward position.

FIG. 9 is a side perspective view of the present invention shown with the right-hand lever in a rearward position. As shown in this figure, when the top end of the lever 4 is pushed forward by the player, the tension on the cable 16 that is attached to that particular lever decreases, thereby allowing the platform spring 13 on the same side of the platform 5*c* as the lever to compress (through release of tension). Because the other lever 4 is still maintaining tension on the other side of the platform 5*c* (that is, the left-hand lever is in a forward position), the right-hand side of the platform 5*c* rises while the left-hand side of the platform remains in the same position as that shown in FIG. 5, thereby causing the platform 5*c* to appear tilted to the left, as shown. Because all three of the upper platform 5*a*, 5*b*, 5*c* are connected via the connecting rod 19, when the lowest of the three upper platforms 5*c* tilts in one direction, the other two upper platforms 5*a*, 5*b* tilt in the same direction.

Figure 10:
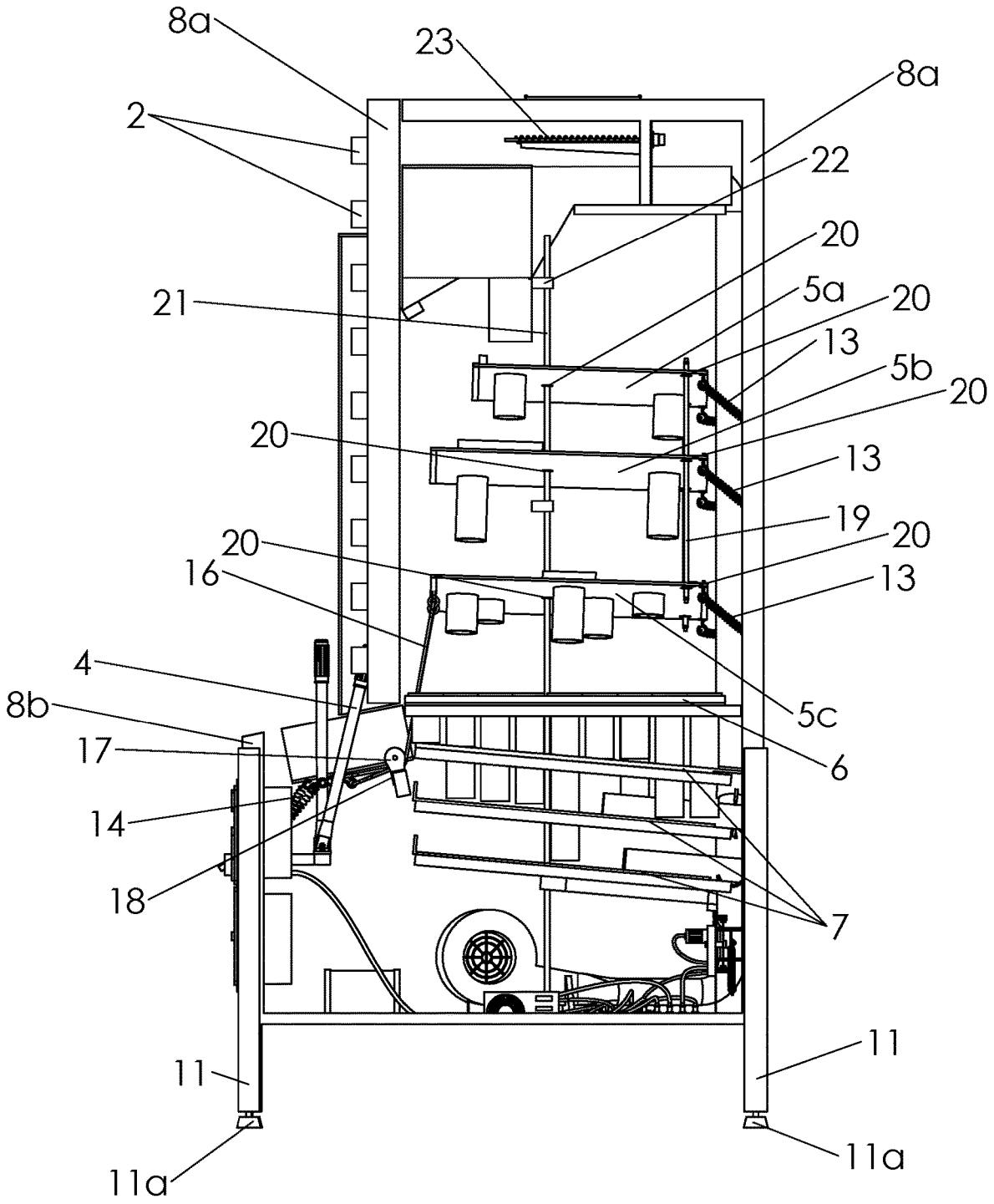
FIG. 10 is a side view of the present invention shown with the right-hand lever in a rearward position.

FIG. 10 is a side view of the present invention shown with the right-hand lever in a rearward position. This figure shows the platforms 5*a*, 5*b*, 5*c* in the same position as that shown in FIG. 9. Note that the perforated platform 6 and lower platforms 7*a*, 7*b*, 7*c* do not move.

Figure 11:
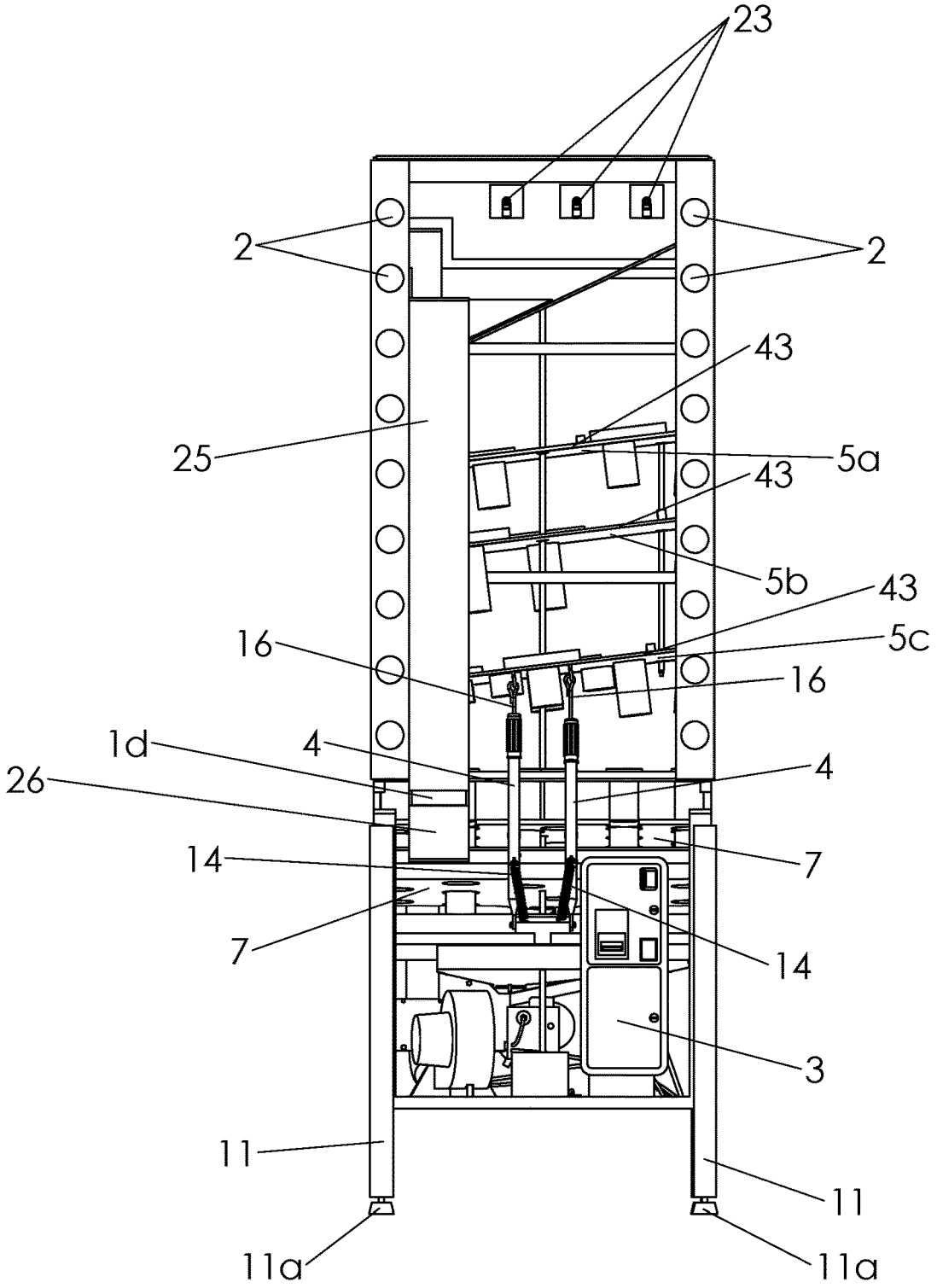
FIG. 11 is a front view of the present invention shown with the right-hand lever in a rearward position.

FIG. 11 is a front view of the present invention shown with the right-hand lever in a rearward position. As shown in this figure, the connecting rod 19 ensures that the three upper platforms 5*a*, 5*b*, 5*c* remain parallel to one another even when tilted.

Figure 12:
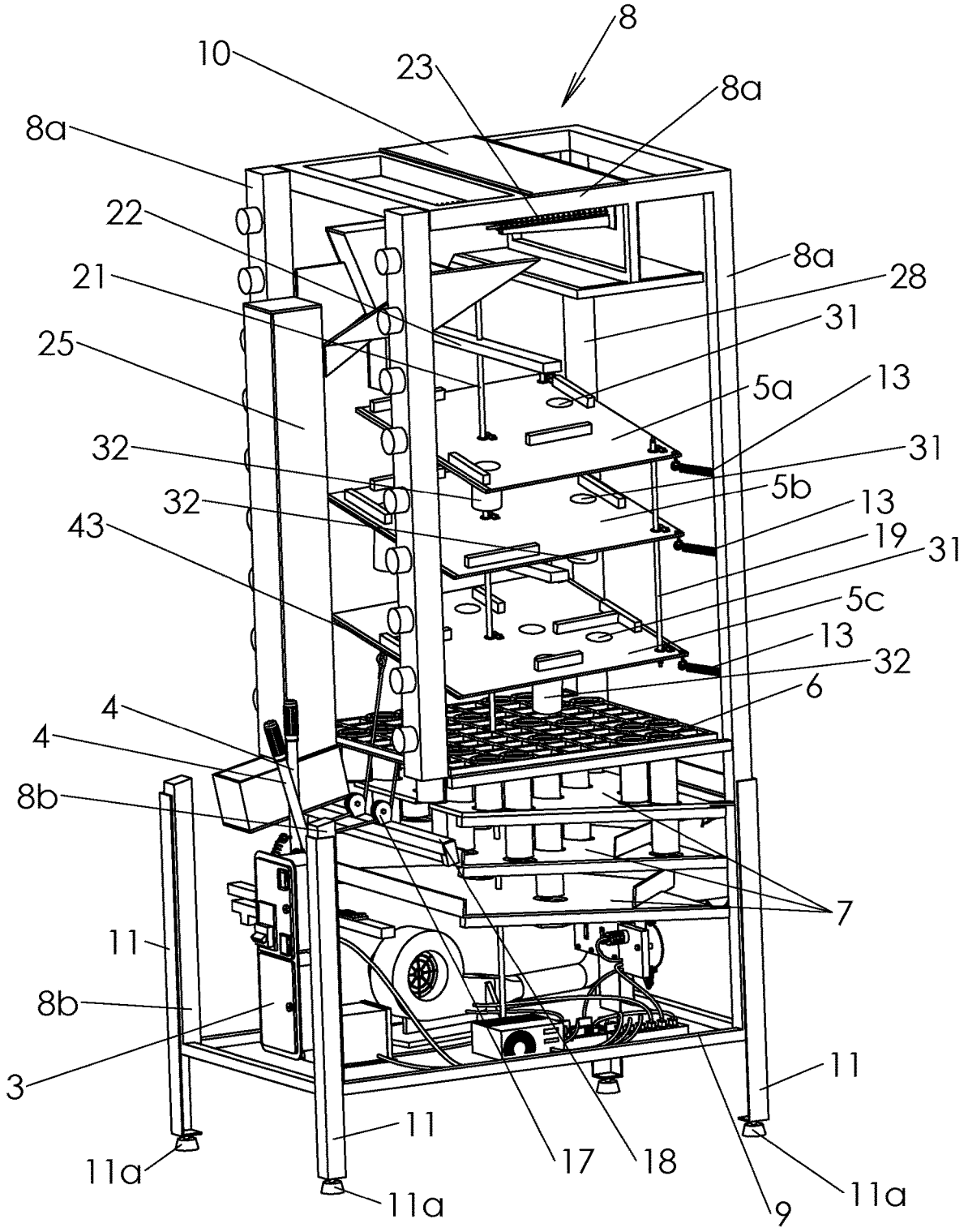
FIG. 12 is a side perspective view of the present invention shown with the right-hand lever in a forward position.

FIG. 12 is a side perspective view of the present invention shown with the right-hand lever in a forward position. When the player pulls the lever 4 toward himself, the cable 16 pulls the front end of the platform 5*a* forward, thereby causing that side of the platform (the right side) to tilt downward, as shown. Because of the connecting rod 19, all three of the upper platforms 5*a*, 5*b*, 5*c* tilt in the same direction. As shown in this figure, each of the upper platforms 5*a*, 5*b*, 5*c* comprises one or more ball-directing walls 30 disposed on the surface of the platform. Each of the upper platforms 5*a*, 5*b*, 5*c* also comprises one or more holes 31 for passage of a ball therethrough to the next lowest platform. Underneath each hole 31 is a tube 32 that extends downwardly from the bottom surface of the platform 5*a*, 5*b*, 5*c*. In a preferred embodiment, the tubes 32 are of varying lengths.

Figure 13:
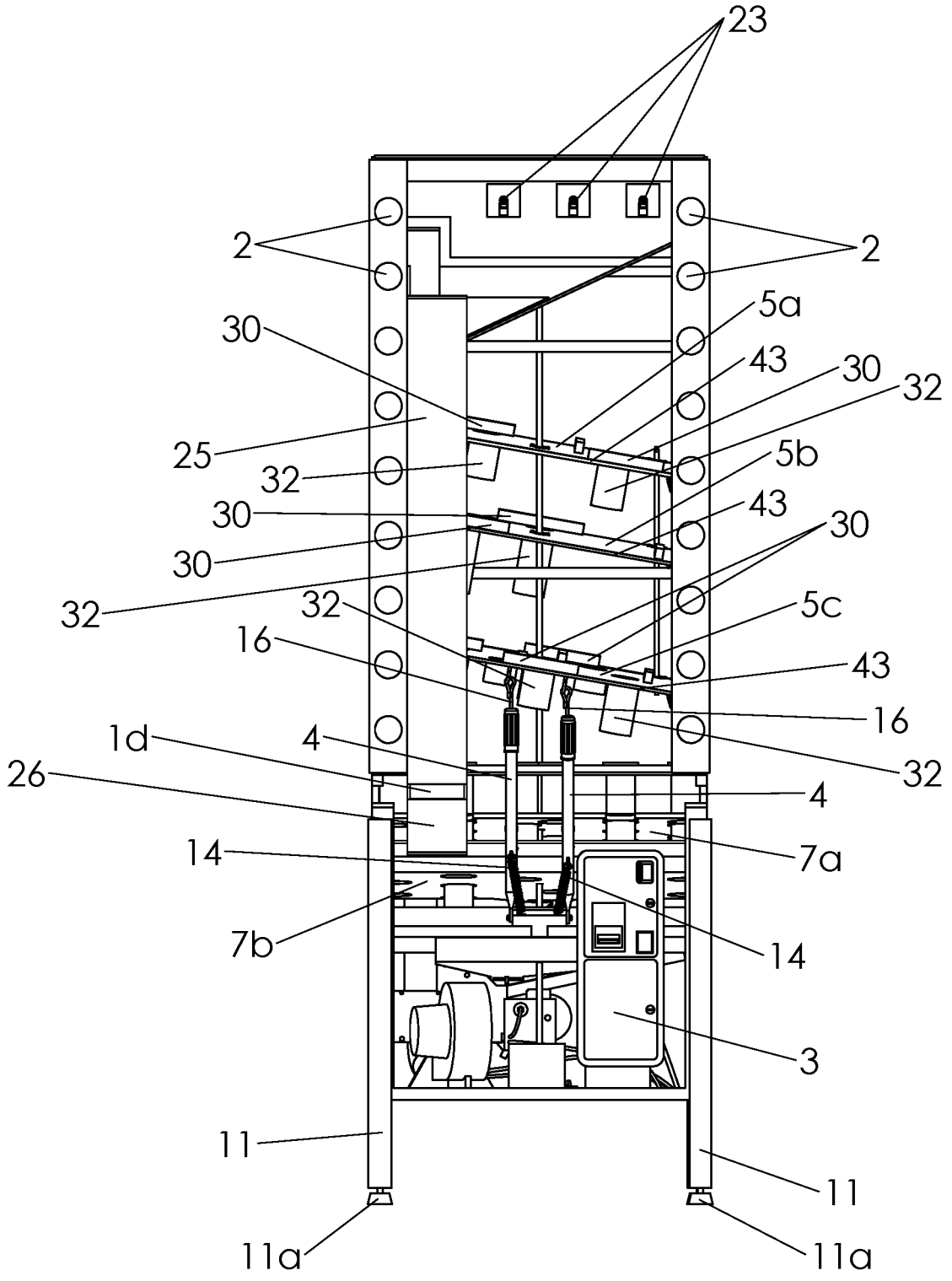
FIG. 13 is a side view of the present invention shown with the right-hand lever in a forward position.
Figure 14:
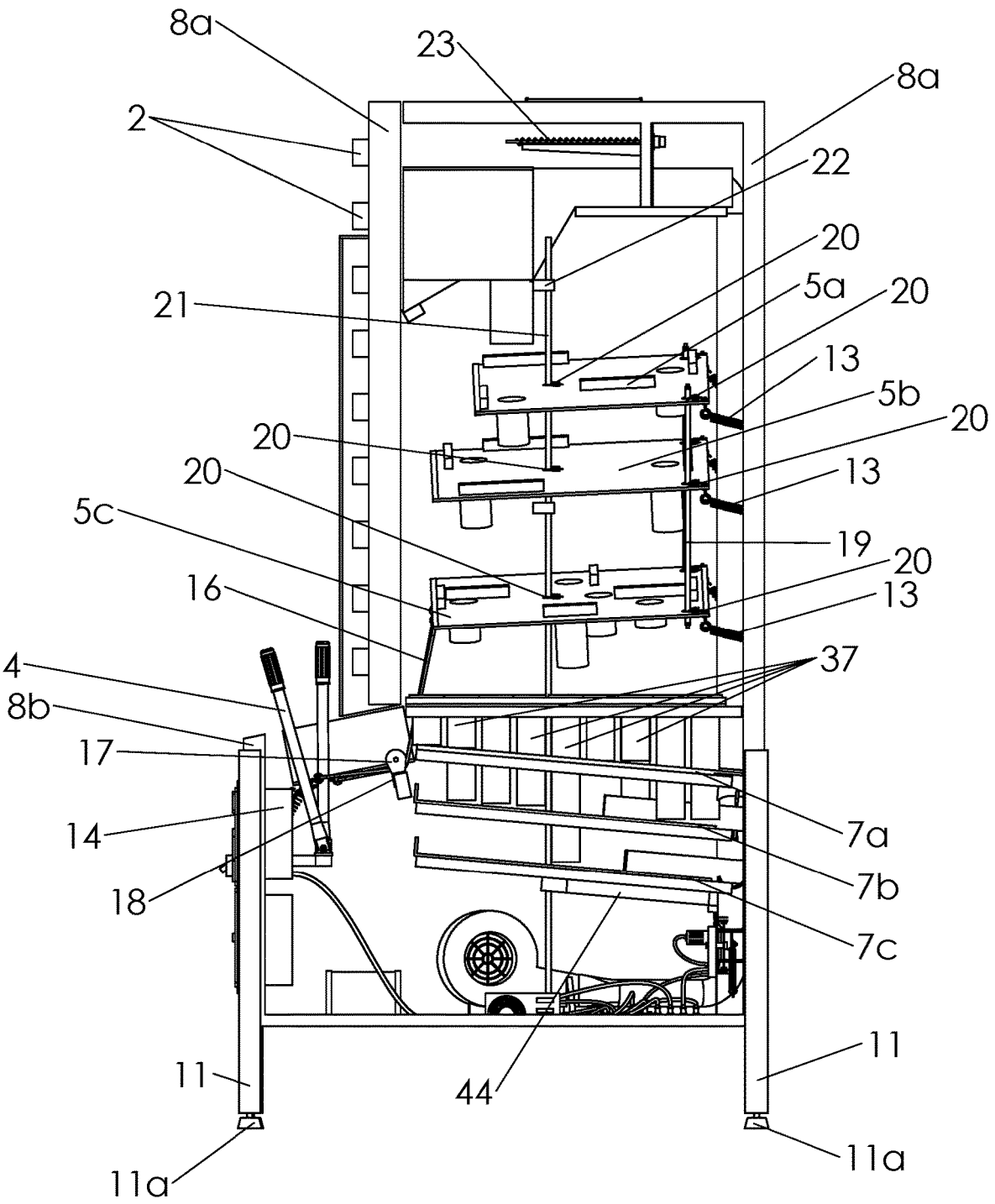
FIG. 14 is a front view of the present invention shown with the right-hand lever in a forward position.

FIG. 13 is a side view of the present invention shown with the right-hand lever in a forward position, and FIG. 14 is a front view of the present invention shown with the right-hand lever in a forward position. This figure shows the ball-directing walls 30, the holes 31, and the downwardly extending tubes 32 on each of the upper platforms 5*a*, 5*b*, 5*c*. By manipulating the levers 4, the player can attempt to direct the ball through particular holes, into particular tubes, and onto the next lower platform. Once the ball has passed through to the perforated platform 6, it passes through either an open hole to the first lower platform 7*a* or one of a plurality of downwardly extending tubes 37 arranged randomly underneath the perforated platform 6. Some of the tubes 37 terminate at or above the first lower platform 7*a*, some extend through a hole in the first lower platform 7*a* and terminate at or above the second lower platform 7*b*, and at least one extends through vertically aligned holes in the first and second lower platforms 7*a*, 7*b* and terminates at or above the third lower platform 7*c* (see also FIG. 6).

Figure 15:
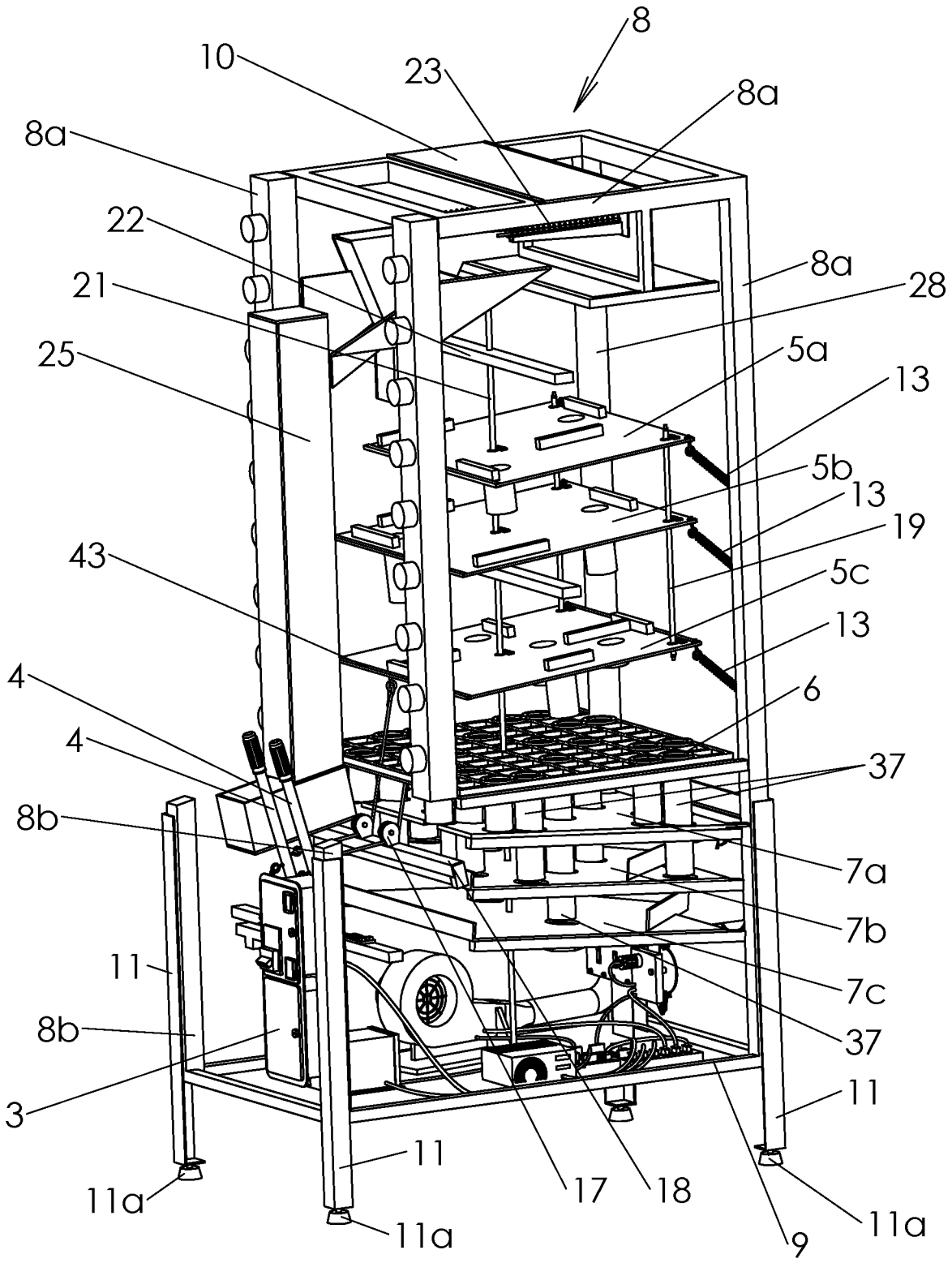
FIG. 15 is a side perspective view of the present invention shown with both levers in a forward position.

FIG. 15 is a side perspective view of the present invention shown with both levers in a forward position. In this position, the levers 4 place tension on the cables 16, causing the front edge of the lower platform 5*c* to tilt downward. As the front edge of the lower platform 5*c* tilts downward, the rear edge of the same platform tilts upward. Because the connecting rod 19 holds all three of the upper platforms 5*a*, 5*b*, 5*c* in a fixed spatial relationship to one another, the rear edges of the other two upper platforms 5*b*, 5*c* also tilt upward. As this happens, the front edges of the two other upper platforms 5*b*, 5*c* tilt downward at the same angle as the lowest of the three upper platforms 5*a*.

Figure 16:
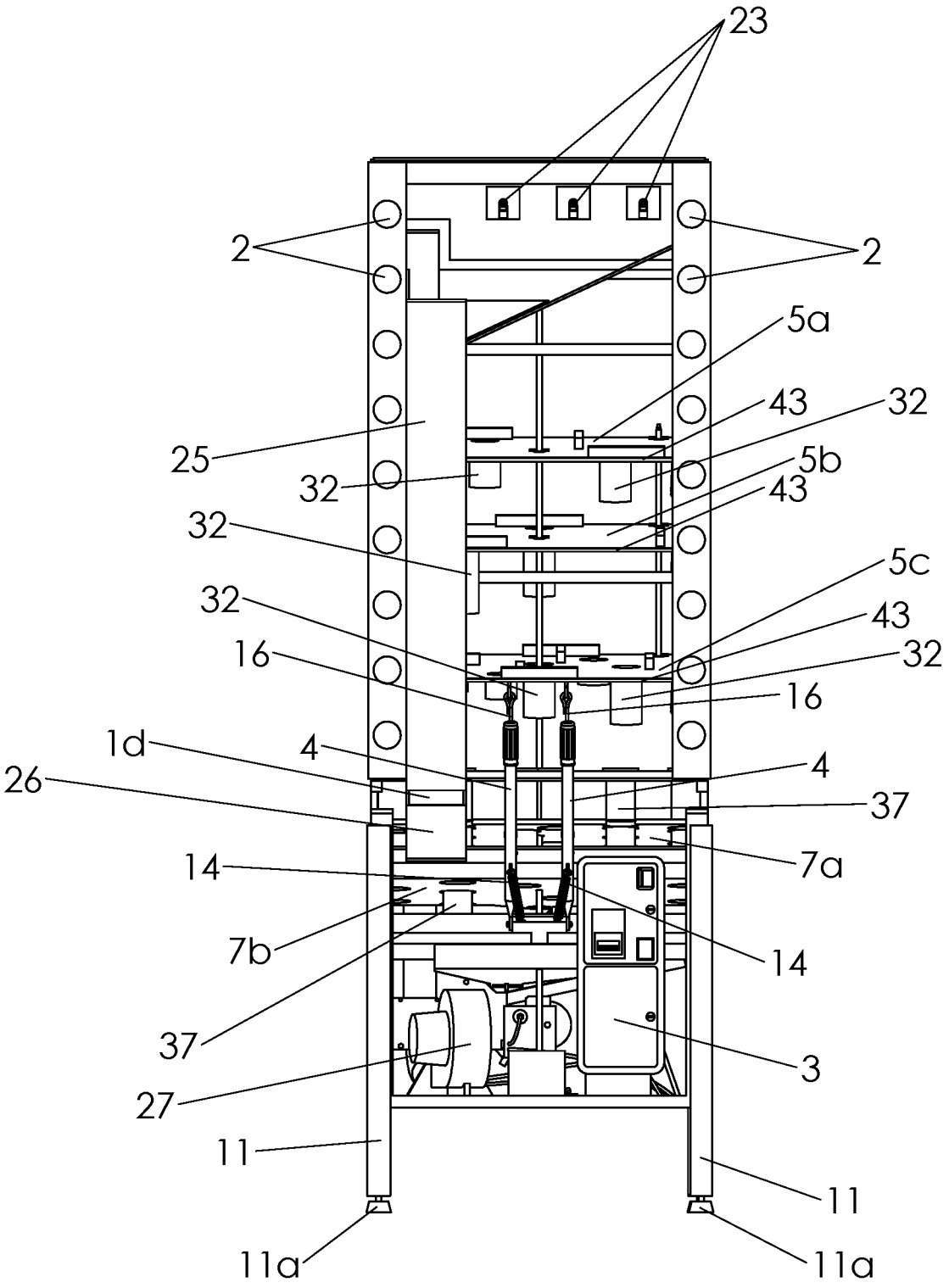
FIG. 16 is a side view of the present invention shown with both levers in a forward position.
Figure 17:
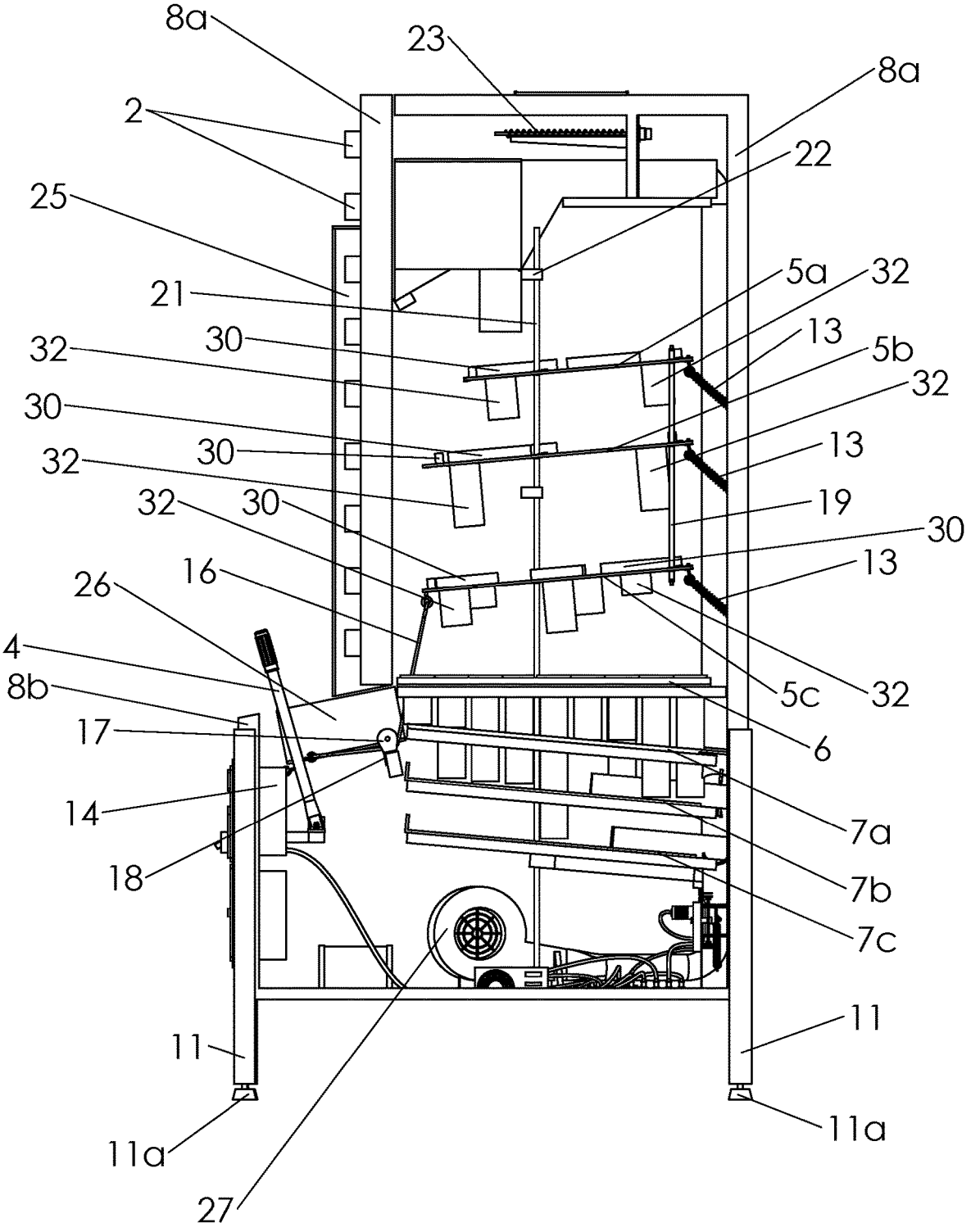
FIG. 17 is a front view of the present invention shown with both levers in a forward position.

This same spatial relationship is shown in FIGS. 16 and 17. FIG. 16 is a side view of the present invention shown with both levers in a forward position, and FIG. 17 is a front view of the present invention shown with both levers in a forward position. In practice, the player may not necessarily move both levers in the same direction or to the same degree. In this manner, the player may control the precise angle of each of the upper platforms as the ball travels from one platform to the next.

Figure 18:
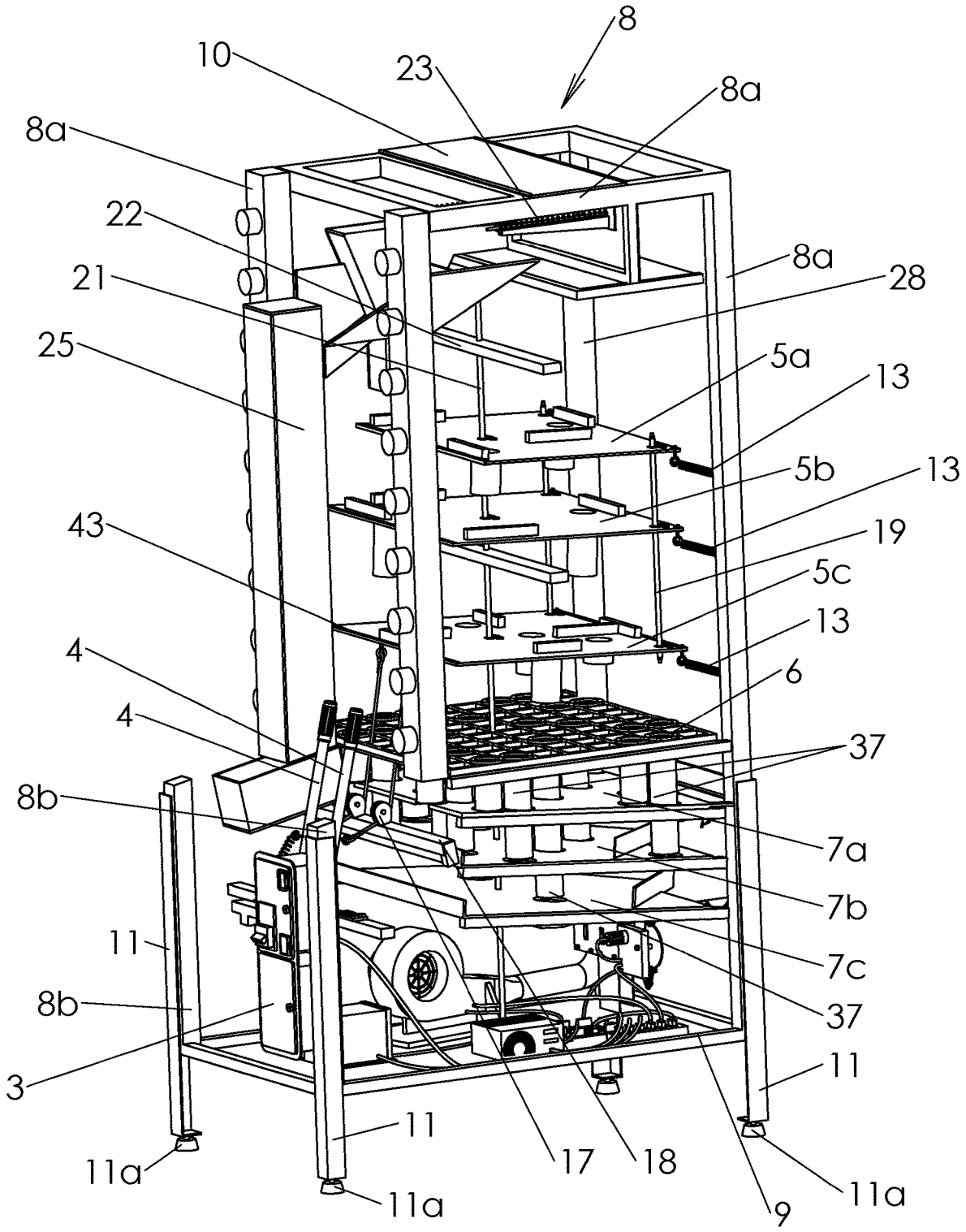
FIG. 18 is a side perspective view of the present invention shown with both levers in a rearward position.
Figure 19:
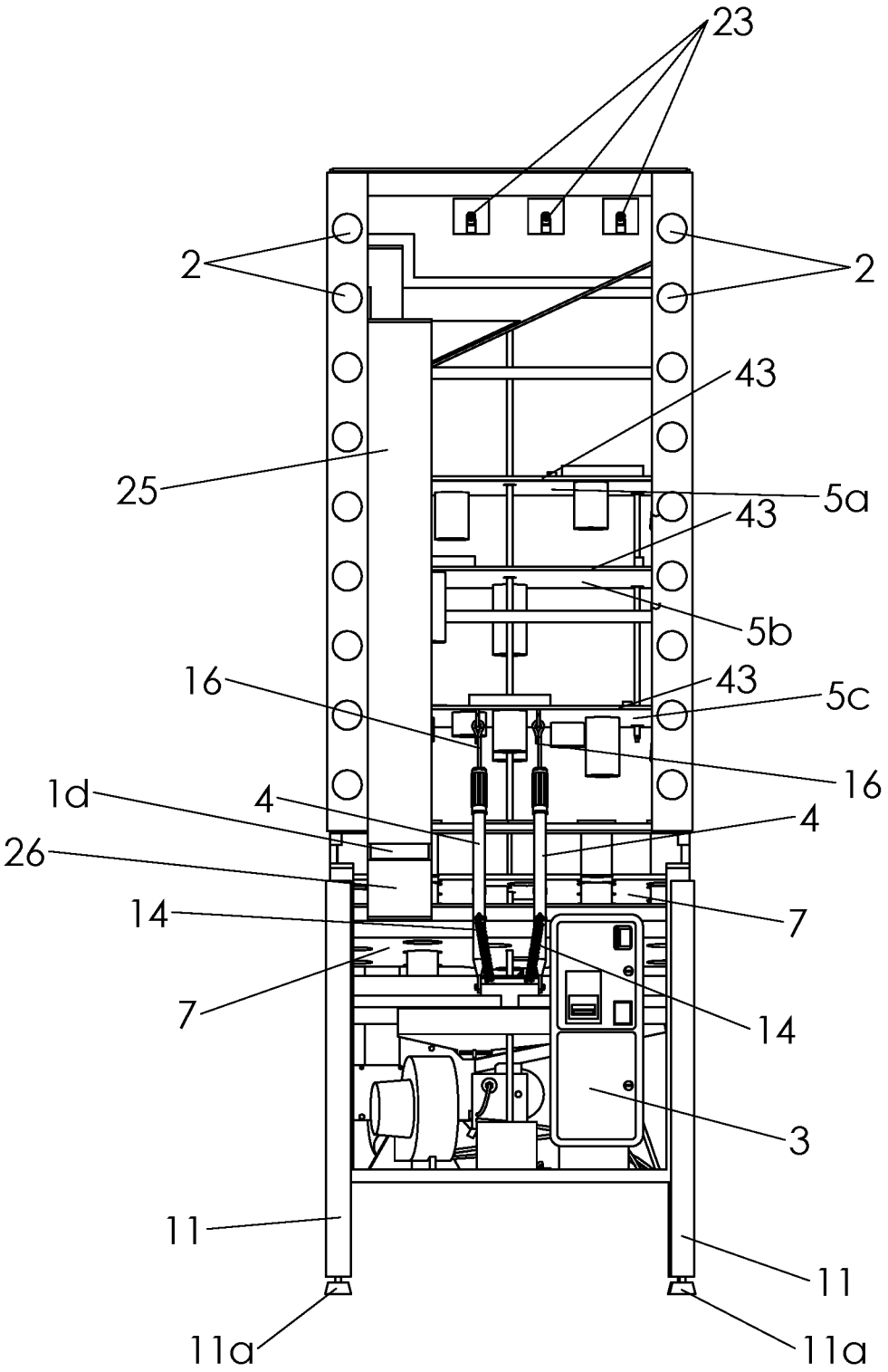
FIG. 19 is a side view of the present invention shown with both levers in a rearward position.
Figure 20:
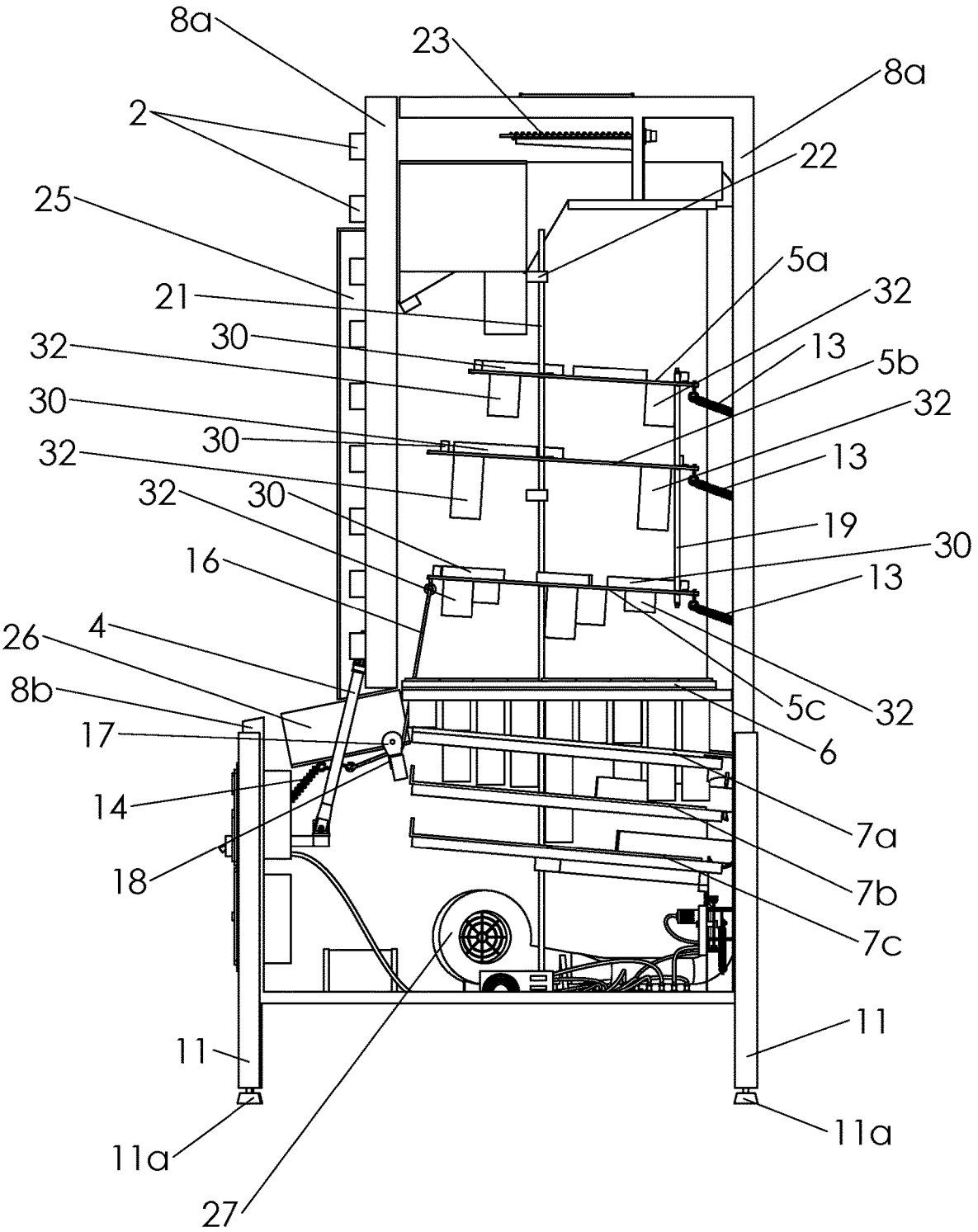
FIG. 20 is a front view of the present invention shown with both levers in a rearward position.

FIGS. 18-20 are, respectively, a side perspective view, a side view, and a front view of the present invention shown with both levers in a rearward position. In this position, the rear edges of all three of the upper platforms 5*a*, 5*b*, 5*c* are tilted downward by the force of the platform spring 13 when pressure on the cable 16 is released. Note that the lever springs 14, the cable 16, and the platform springs 13 are all configured so that when no pressure is placed on the levers 4 by the player, the levers 4 are upright, and the upper platforms 5*a*, 5*b*, 5*c* are level (as shown in FIG. 6).

Figure 21:
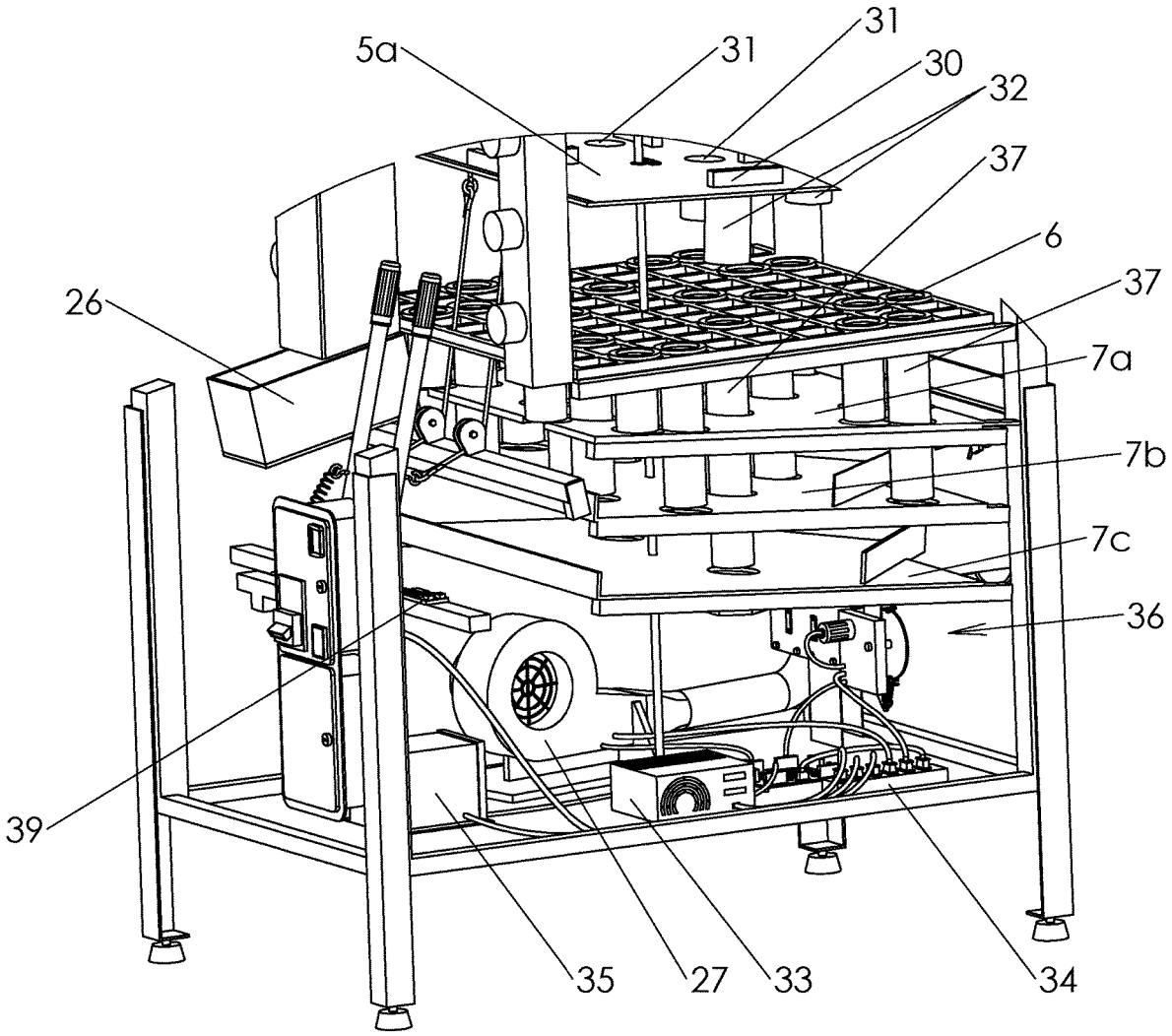
FIG. 21 is a detail view of the floor of the interior compartment.

FIG. 21 is a detail view of the floor of the interior compartment. As shown in this figure, several components of the invention are situated on the floor of the interior compartment. These components include the ball blower 27, a volt converter 33 (for converting 110-volt AC to 12-volt DC power supply), a power strip 34 for various electrical connections, and a transformer 35 for operation of the lights. The ball feeder assembly 36, which is discussed more fully below, is also shown in this figure. This figure also shows the digital readout processor 39, which is configured to count the number of plays, count the money deposited into the money collection box 3, and adjust the volume on the optional speakers (not shown).

Figure 22:
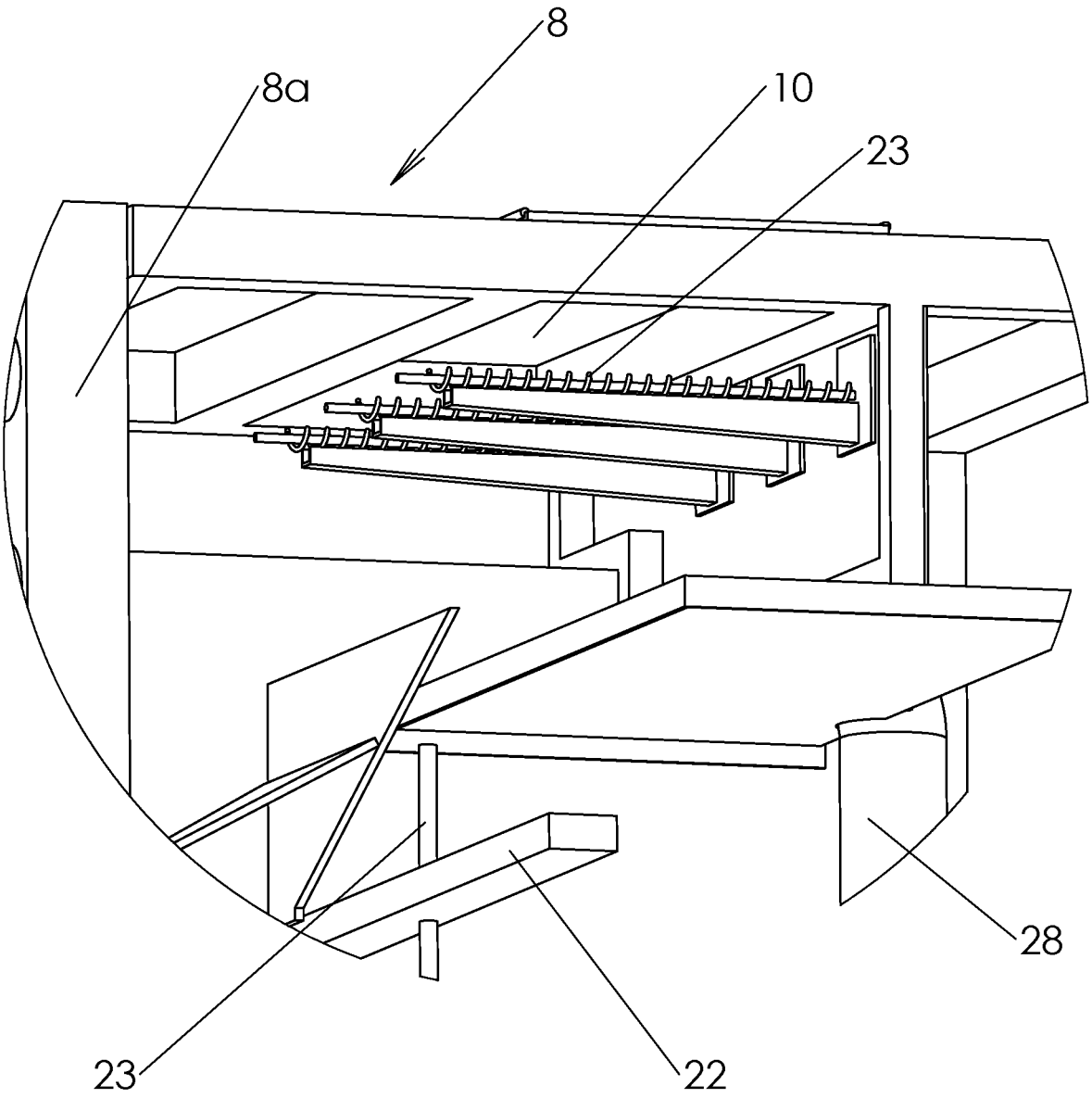
FIG. 22 is a detail view of the prize augers of the present invention.

FIG. 22 is a detail view of the prize augers of the present invention. In operation, various prizes would be hung from the prize augers 23, which are configured to release a prize onto the first prize chute 24 upon activation of the corresponding sensor (see FIG. 29).

Figure 23:
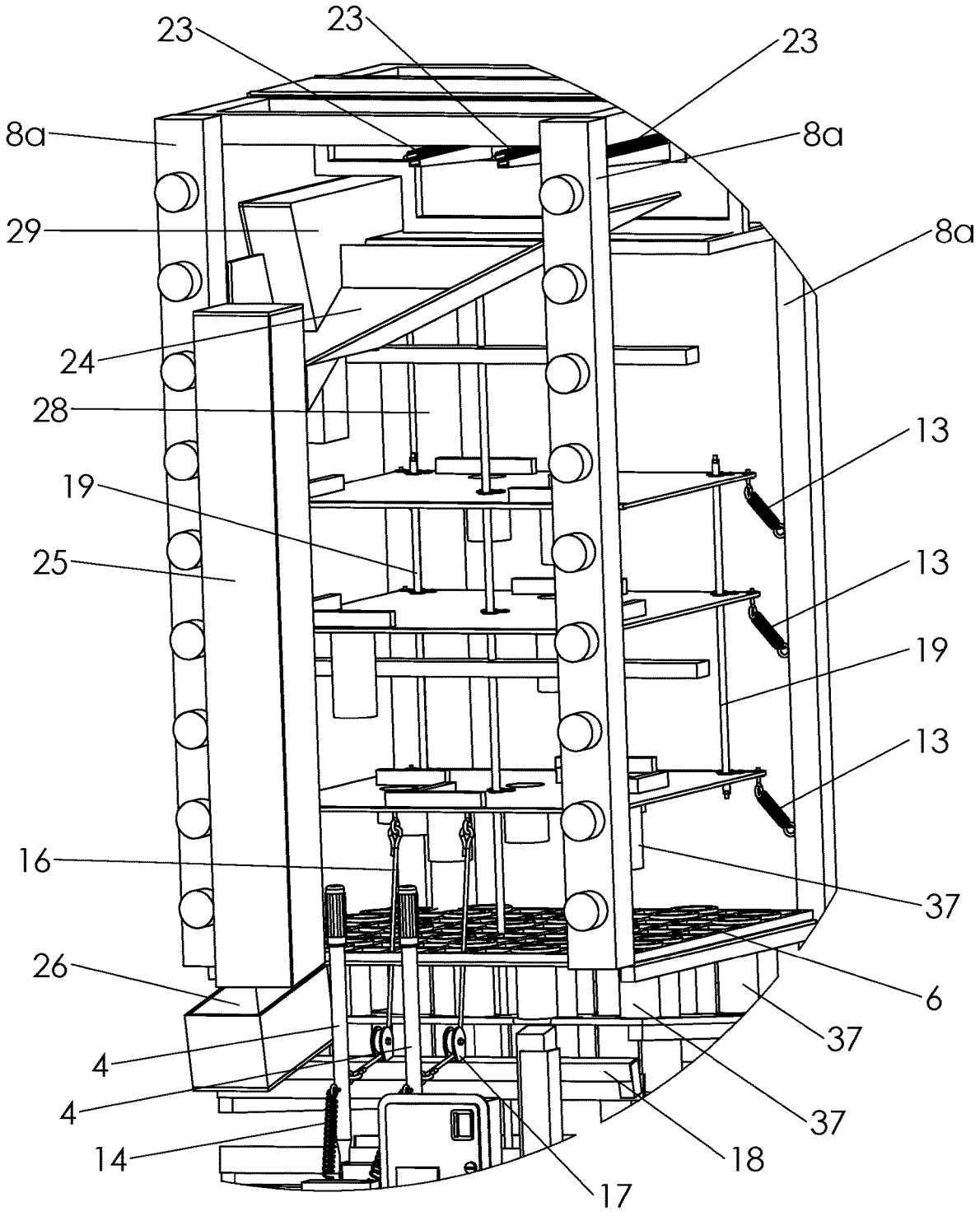
FIG. 23 is a detail view of the upper platforms and prize chutes.

FIG. 23 is a detail view of the upper platforms and prize chutes. All parts shown in this figure have been previously discussed.

Figure 24:
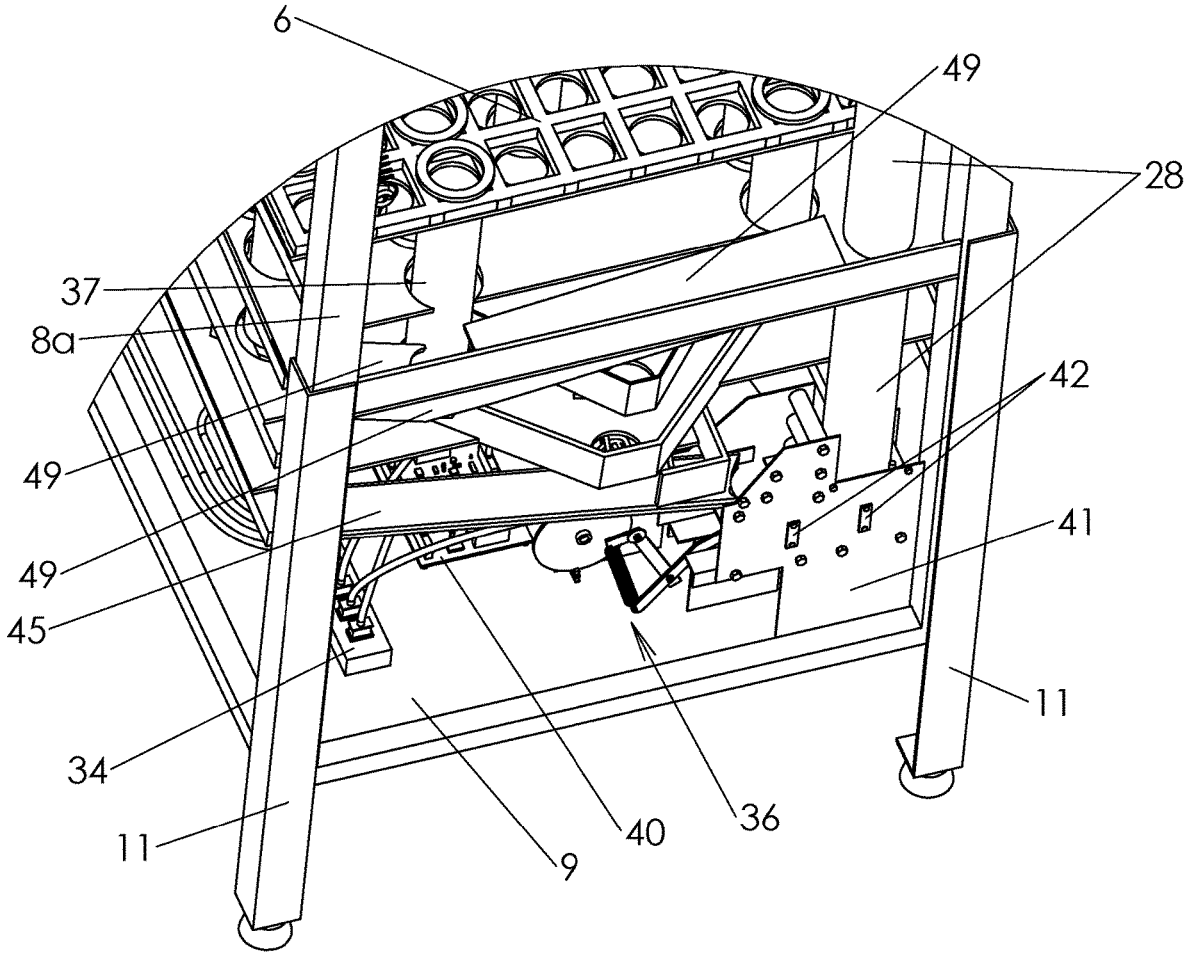
FIG. 24 is a detail perspective view of the lower platforms.

FIG. 24 is a detail perspective view of the lower platforms. This figure shows the digital I/O (input/output) board 40, which is configured to start the game (upon deposit of the appropriate monetary amount) and to control the prize augers 23, the ball blower 27, and the ball feeder assembly 36. In addition, FIG. 24 shows the cradle 49 that is situated at the back end of the first lower platform 7*a* and configured to receive balls from the first lower platform 5*a*. The cradle 49 is comprised of a back panel and two slanted floor panels that terminate in a hole that is situated above the top end of the ball trough 45, as shown. In this manner, the cradle 49 is configured to direct balls coming off of the first lower platform 7*a* into the ball trough 45, which delivers the balls to the ball feeder assembly 36.

Figure 25:
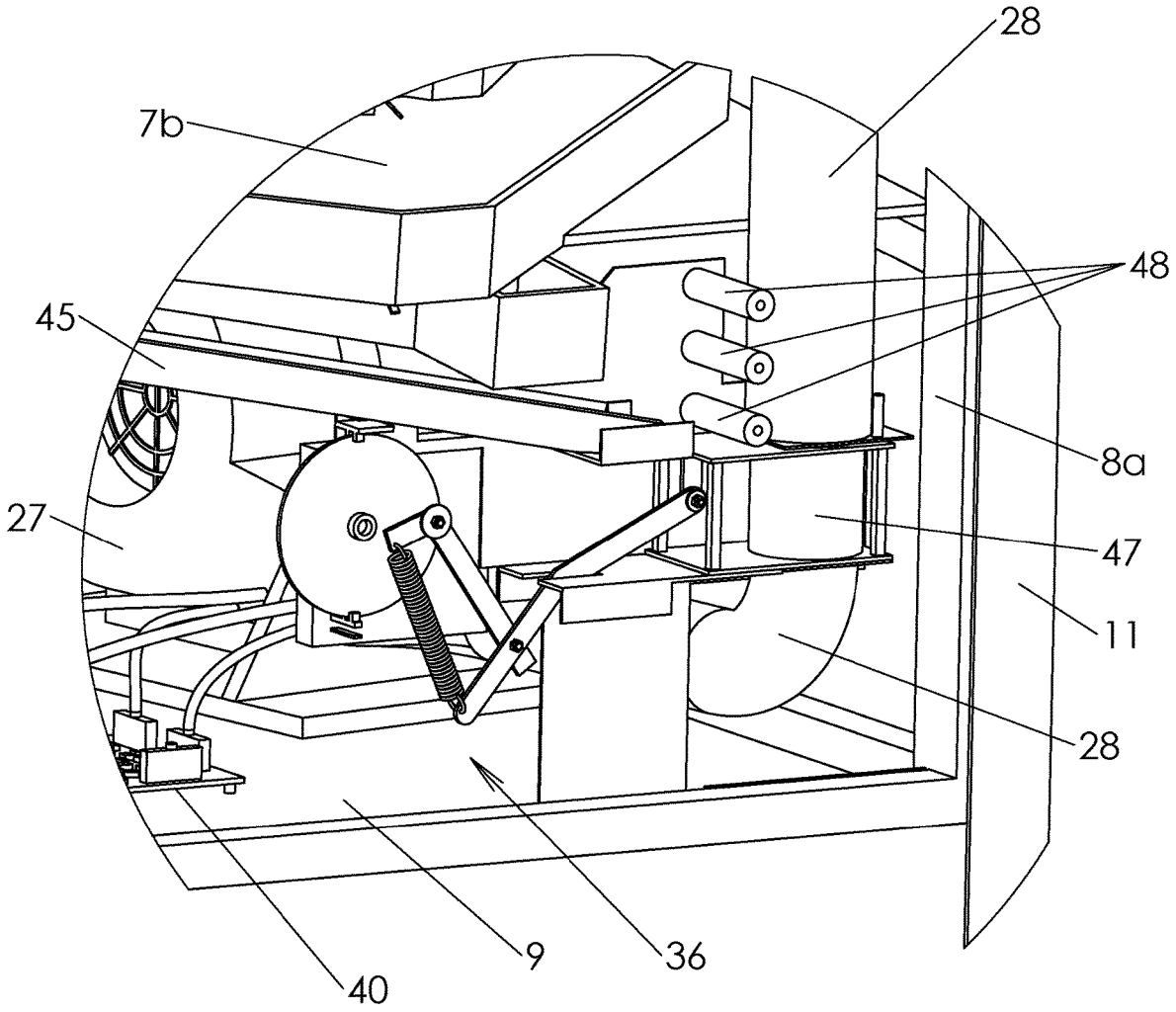
FIG. 25 is a detail perspective view of the ball feeder assembly in a ball hold position.
Figure 26:
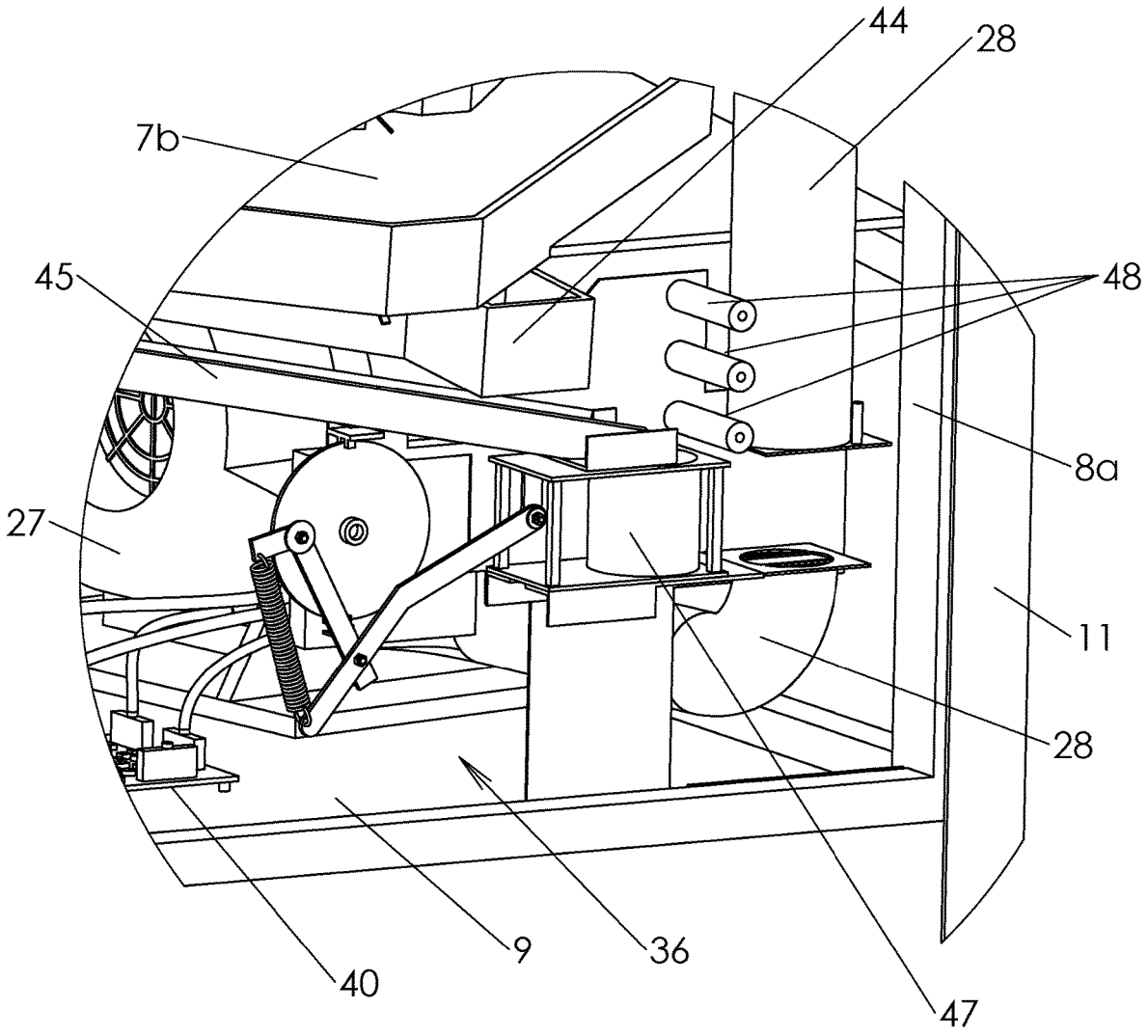
FIG. 26 is a detail perspective view of the ball feeder assembly in a ball return position.
Figure 27:
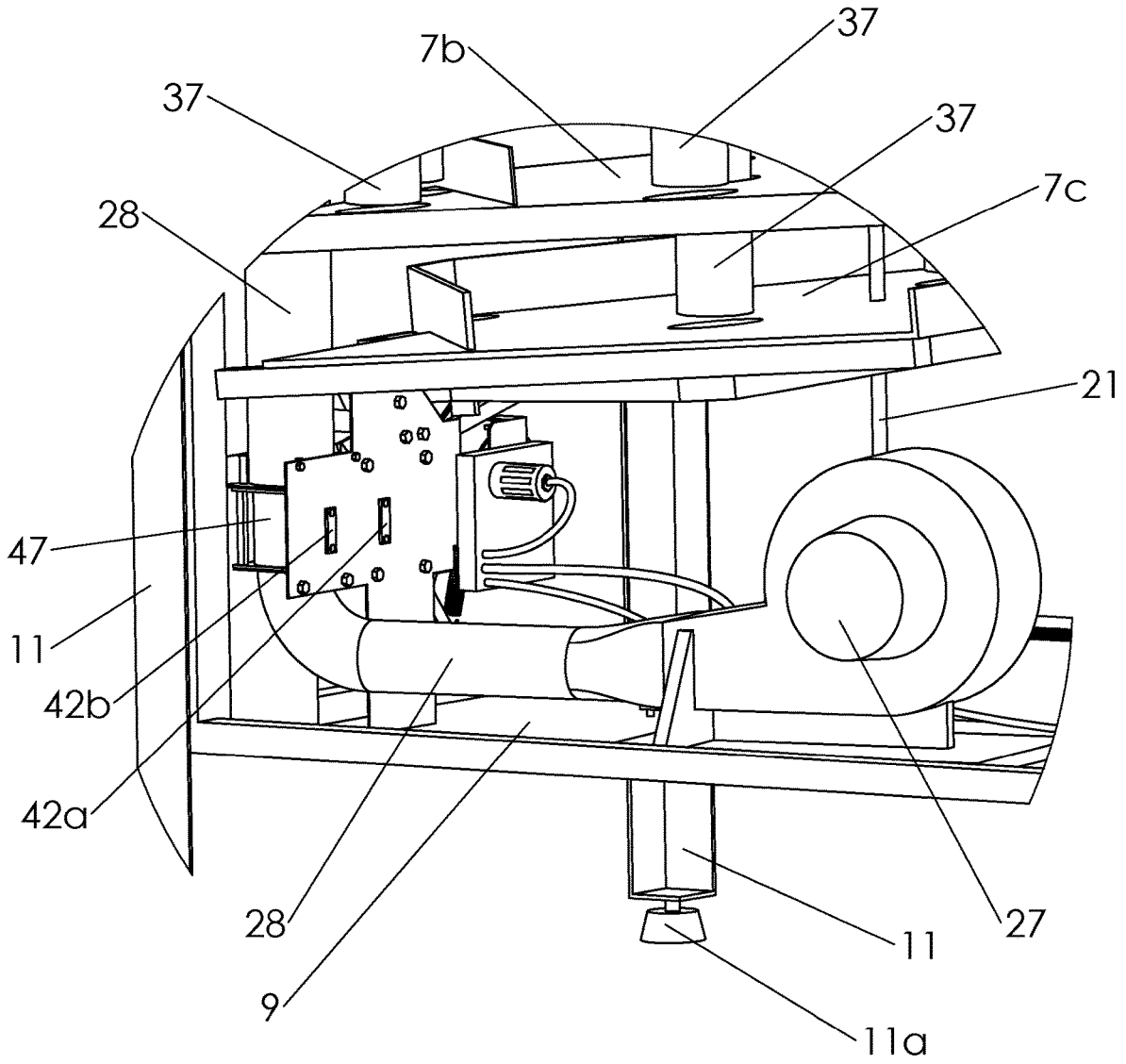
FIG. 27 is a detail perspective view of the ball blower and related components.

FIG. 25 is a detail perspective view of the ball feeder assembly in a ball hold position. FIG. 26 is a detail perspective view of the ball feeder assembly in a ball return position. Note that the rear plate 41 that is shown in FIGS. 24 and 27 has been removed from these two figures for clarity. This plate 41 holds the two ball sensors 42, which detect whether the ball feeder assembly is in a ball return position. As shown in FIGS. 25 and 26, the present invention comprises a ball trough 45 that is configured to receive balls from the first lower platform 7*a*, the second lower platform 7*b*, the third lower platform 7*c*, and the ramp 44, as described above. The trough 45 is slanted downwardly toward the ball feeder assembly 36. In FIG. 25, the ball (not shown) would be deposited into a receptacle 47 that is situated at the low end of the trough 45. When the ball is in this position, it triggers the first ball sensor 42*a*, which cause the ball feeder assembly 36 to move into the position shown in FIG. 26. In the latter position, the receptacle 47 has been moved laterally so that it is in line with the bottom end of the vertical ball chute 28. When the receptacle 47 is in this position, it triggers the second ball sensor 42*b*, which activates the ball blower 27, thereby delivering the ball back up through the vertical ball chute 28 and triggering the next game. The three positional dowels 48 shown in FIG. 25 are configured to stop the ball at the bottom of the trough 45.

FIG. 27 is a detail perspective view of the ball blower and related components. In this figure, the ball feeder assembly 36 is in a ball return position. The ball sensors 42 activate the ball blower 27 to deliver a ball up through the vertical ball chute 28 and out through the downwardly pointed funnel 29 to start the game.

Figure 29:
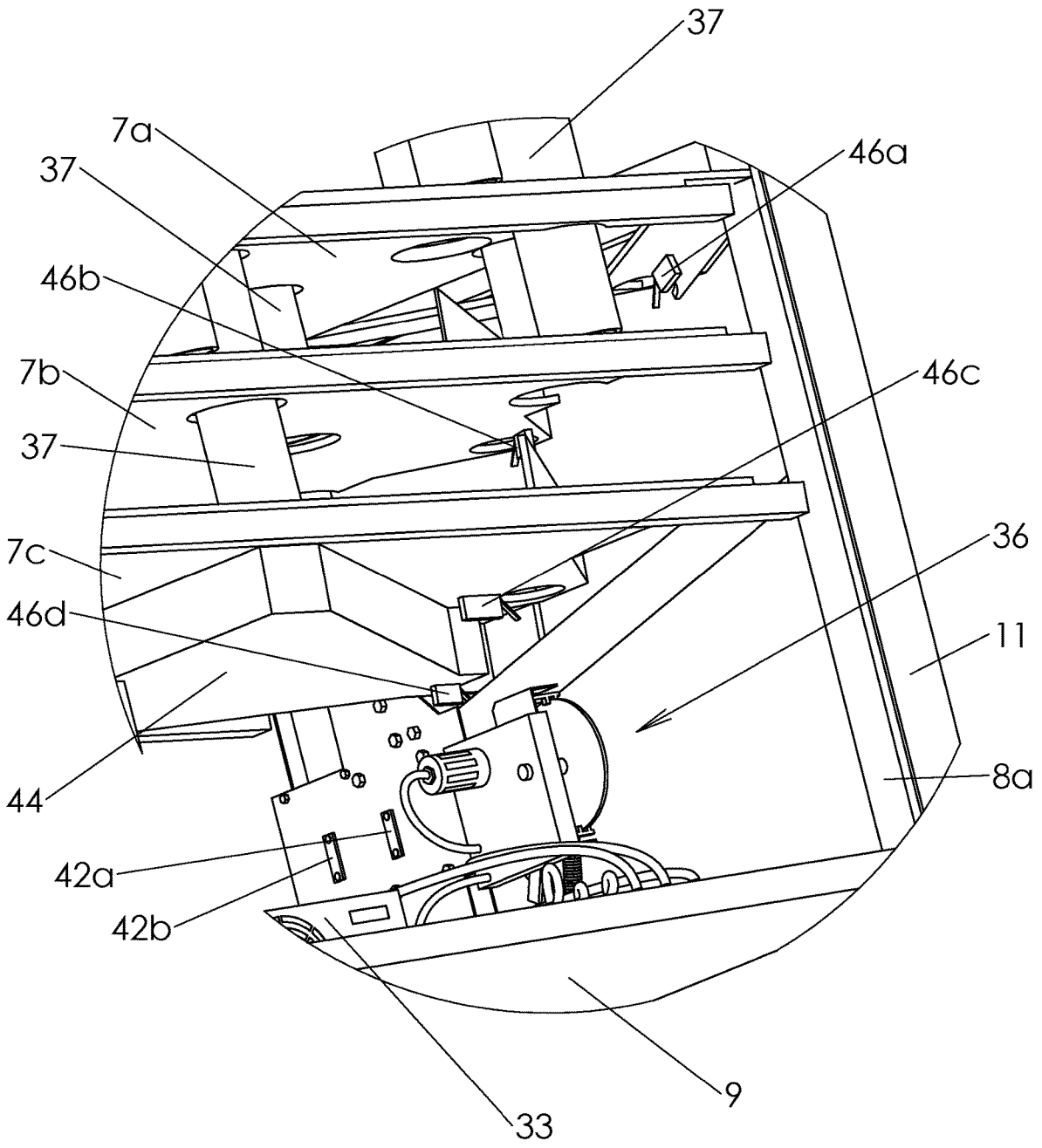
FIG. 29 is a first detail perspective view of the back ends of the lower platforms and ramp showing the four sensors that determine prize level or no prize.

FIG. 29 is a detail perspective view of the lower platforms showing the four prize sensors. During play, if the ball ends up on the first lower platform 7*a*, it is directed (by gravity) to a hole at the back end of the first lower platform 7*a* and deposited onto the top end of the ball trough 45, which feeds all of the balls to the ball feeder assembly 36. If the ball ends up on the second lower platform 7*b*, it is directed (by gravity) to a hole at the back end of the second lower platform 7*b*; this hole is also aligned vertically with a hole at the back end of the third lower platform 7*c* so that if the ball passes through the hole at the back end of the second lower platform 7*b*, it also passes through the hole at the back end of the third lower platform 7*c*. If the ball ends up on the third lower platform 7*c* during play, it is directed to the hole at the back end of the third lower platform 7*c*. Once the ball passes through the hole at the back end of the third lower platform 7*c*, is it deposited onto the ball trough 45. The third lower platform 7*c* also comprises a hole that is configured to deposit the ball onto the ramp 44. This ramp 44 is configured to trigger the sensor 46 for the grand prize. Note that the second and third lower platforms 7*b*, 7*c* each comprises one or more ball-directing walls 30 that are configured to direct the ball into the hole at the back of the platform (see FIGS. 4 and 8).

As shown in FIG. 29, the present invention comprises four sensors 46, each of which is to configured to trigger a different prize or "no prize" sensor. The first sensor 46*a* in this figure is triggered when the ball passes through the hole in the cradle 49 that is situated at the back end of the first lower platform 7*a*; the triggering of this sensor results in none of the prize augers being activated. The second sensor 46*b* in this figure is triggered when the ball passes through the hole at the back end of the second lower platform 5*b*; the triggering of this sensor results in the first prize auger (for the lowest prize level) being activated. The third sensor 46*c* in this figure is triggered when the ball passes through the hole at the back end of the third lower platform 5*c*; the triggering of this sensor results in the second prize auger (for the medium prize level) being activated. The fourth sensor 46*d* in this figure is triggered when the ball passes through the hole in the third lower platform 5*c* and onto the ramp 44; the triggering of this sensor results in the third prize auger (for the highest prize level) being activated.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. An arcade game comprising:

(a) a housing that forms an interior compartment;

(b) three lower platforms;

(c) a perforated platform; and (d) three upper platforms;

wherein the three lower platforms are situated underneath the perforated platform, tilted toward the back of the housing, and parallel to each other;

wherein the perforated platform is substantially horizontal and comprised of a plurality of apertures configured to allow a ball to pass through them;

wherein the three upper platforms are situated above the perforated platform;

wherein each of two levers situated at a front of the housing is pivotally connected to a lever mounting bracket and mechanically coupled to one of the three upper platforms via a cable and pulley;

wherein a lever spring is attached to each of the two levers and configured to maintain the lever in an upright position when the lever is in a resting position;

wherein a central connecting rod extends through a center of the three upper platforms, and a ball bearing is situated at each point at which the central connecting rod extends through one of the three upper platforms;

wherein a first rear connecting rod is connected to a first rear corner of each of the three upper platforms, and a ball bearing is situated at each point at which the first rear connecting rod connects to one of the three upper platforms; and wherein a second rear connecting rod is connected to a second rear corner of each of the three upper platforms, and a ball bearing is situated at each point at which the second rear connecting rod connects to one of the three upper platforms.

2. The arcade game of claim 1, further comprising a frame;

wherein each of the three upper platforms comprises a pair of platform springs; wherein one of each pair of platform springs is connected on one end to the first rear corner of a corresponding upper platform and on another end to the frame; wherein the second of each pair of platform springs is connected on one end to the second rear corner of the corresponding upper platform and on another end to the frame; and wherein the platform springs are configured to maintain the upper platforms in a substantially horizontal position when the levers are in a resting position.

3. The arcade game of claim 1, further comprising a ramp;

wherein the three lower platforms comprise a first lower platform that is situated directly underneath the perforated platform, a second lower platform that is situated directly underneath the first lower platform, and a third lower platform that is situated directly underneath the second lower platform:

wherein the ramp is situated directly underneath the third lower platform;

wherein each of the first lower platform, the second lower platform, and the third lower platform is configured to deliver the ball to a ball trough;

wherein the ball trough is configured to transfer the ball to a ball blower via a ball feeder assembly; and wherein the ball blower is configured to send the ball through a vertical chute and deposit it onto a highest of the three upper platforms.

4. The arcade game of claim 3, wherein the perforated platform comprises a plurality of tubes that extend downwardly from the perforated platform;

wherein each tube is configured to receive the ball as it passes through one of the plurality of apertures in the perforated platform;

wherein at least one of the downwardly extending tubes terminates above the first lower platform, at least one of the downwardly extending tubes terminates above the second lower platform, and at least one of the downwardly extending tubes terminates above the third lower platform; and wherein the ramp comprises an aperture that is configured to deliver the ball to the ball trough.

5. The arcade game of claim 1, wherein each of the upper platforms and each of the lower platforms comprises one or more ball-directing walls.

6. The arcade game of claim 1, wherein each of the three upper platforms comprises one or more apertures that are configured to allow the ball to pass through them; and wherein each of the three upper platforms comprises at least one tube extending downwardly from an aperture in the upper platform.

7. The arcade game of claim 6, wherein the three upper platforms comprise a third upper platform that is situated directly above the perforated platform, a second upper platform that is situated directly above the second upper platform, and a first upper platform that is situated directly above the second upper platform;

wherein the third upper platform comprises more than one downwardly extending tube, and wherein the downwardly extending tubes of the third upper platform vary in length.

8. The arcade game of claim 3, further comprising:

a plurality of prize augers that are situated above the three upper platforms and configured to deliver a prize to a prize chute and into a prize box; and sensors that are configured to detect whether the ball is delivered to the ball trough from the first lower platform, the second lower platform, the third lower platform, or the ramp and to trigger delivery of a corresponding prize or no prize at all.

* * * * *